US008800777B2

(12) United States Patent
Schneider et al.

(10) Patent No.: US 8,800,777 B2
(45) Date of Patent: Aug. 12, 2014

(54) CYLINDRICAL DEDUSTING APPARATUS FOR PARTICULATE MATERIAL

(71) Applicant: Pelletron Corporation, Lancaster, PA (US)

(72) Inventors: Heinz Schneider, Lancaster, PA (US); Paul Wagner, Lancaster, PA (US)

(73) Assignee: Pelletron Corporation, Lancaster, PA (US)

( * ) Notice: Subject to any disclaimer, the term of this patent is extended or adjusted under 35 U.S.C. 154(b) by 12 days.

(21) Appl. No.: 13/681,396

(22) Filed: Nov. 19, 2012

(65) Prior Publication Data

US 2013/0074282 A1 Mar. 28, 2013

Related U.S. Application Data

(63) Continuation-in-part of application No. 12/718,494, filed on Mar. 5, 2010, now Pat. No. 8,312,994.

(51) Int. Cl.

| | |
|---|---|
| ***B07B 7/00*** | (2006.01) |
| ***B07B 11/04*** | (2006.01) |
| ***B07B 11/06*** | (2006.01) |
| ***B07B 9/02*** | (2006.01) |
| ***B07B 4/08*** | (2006.01) |
| ***B07B 4/02*** | (2006.01) |

(52) U.S. Cl.

CPC . *B07B 4/02* (2013.01); *B07B 11/04* (2013.01); *B07B 11/06* (2013.01); *B07B 9/02* (2013.01); *B07B 4/08* (2013.01)

USPC ..... 209/139.1; 209/138; 209/150

(58) Field of Classification Search

USPC ..... 209/136–139.1, 142, 146, 149, 150, 209/720, 721, 477

See application file for complete search history.

(56) References Cited

U.S. PATENT DOCUMENTS

| | | | | |
|---|---|---|---|---|
| 940,469 | A * | 11/1909 | Middleton | 209/138 |
| 1,522,151 | A | 1/1925 | Stebbins | |
| 2,729,330 | A | 1/1956 | Raymond | |
| 2,739,708 | A | 3/1956 | Denovan | |
| 2,795,329 | A | 6/1957 | Franz | |
| 3,941,687 | A * | 3/1976 | Peterson | 209/136 |
| 4,268,294 | A * | 5/1981 | Laughlin et al. | 65/506 |
| 5,035,331 | A | 7/1991 | Paulson | |
| 5,294,002 | A | 3/1994 | Moses | |
| 1,499,725 | A | 7/1994 | Holt | |
| 5,695,069 | A | 12/1997 | Mortrud | |
| 6,712,216 | B2 | 3/2004 | Van Oirschot | |
| 7,380,670 | B2 | 6/2008 | Paulson | |
| 8,016,116 | B2 | 9/2011 | Schneider | |
| 8,312,994 | B2 * | 11/2012 | Schneider et al. | 209/139.1 |

* cited by examiner

*Primary Examiner* — Joseph C Rodriguez

(74) *Attorney, Agent, or Firm* — Miller Law Group, PLLC

(57) ABSTRACT

A cylindrical dedusting apparatus has an upper material infeed opening to introduce material into a frusto-conical infeed hopper centered over the tip of a conical wash deck supported over an air infeed conduit. Air is blown through slots and openings in the surface of the wash deck to separate dust and debris from the particulate material. The dust-laden air is discharged by passing between the infeed hopper and a cylindrical sleeve to enter into a circular collector for discharge from the apparatus. Flow rate of material over the wash deck is adjusted by vertically moving the infeed hopper within the sleeve relative to the wash deck to vary the dimension of the gap through which material flows onto the wash deck. A closed loop air system can be used with the cylindrical dedusting apparatus with a bleed air module that reduces air flow into the apparatus.

26 Claims, 18 Drawing Sheets

Fig. 10
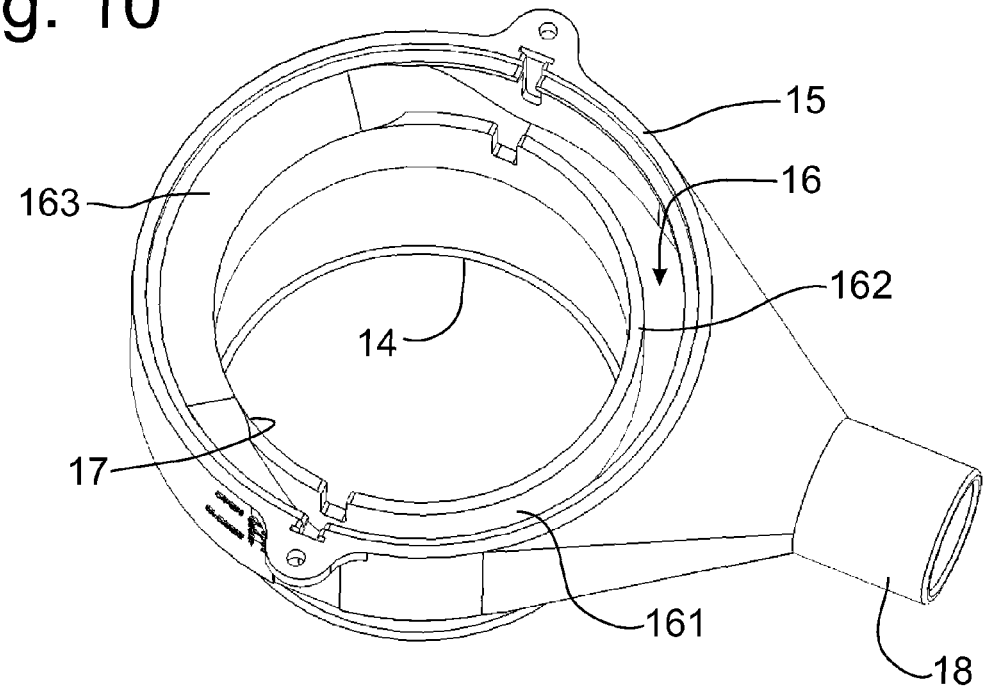
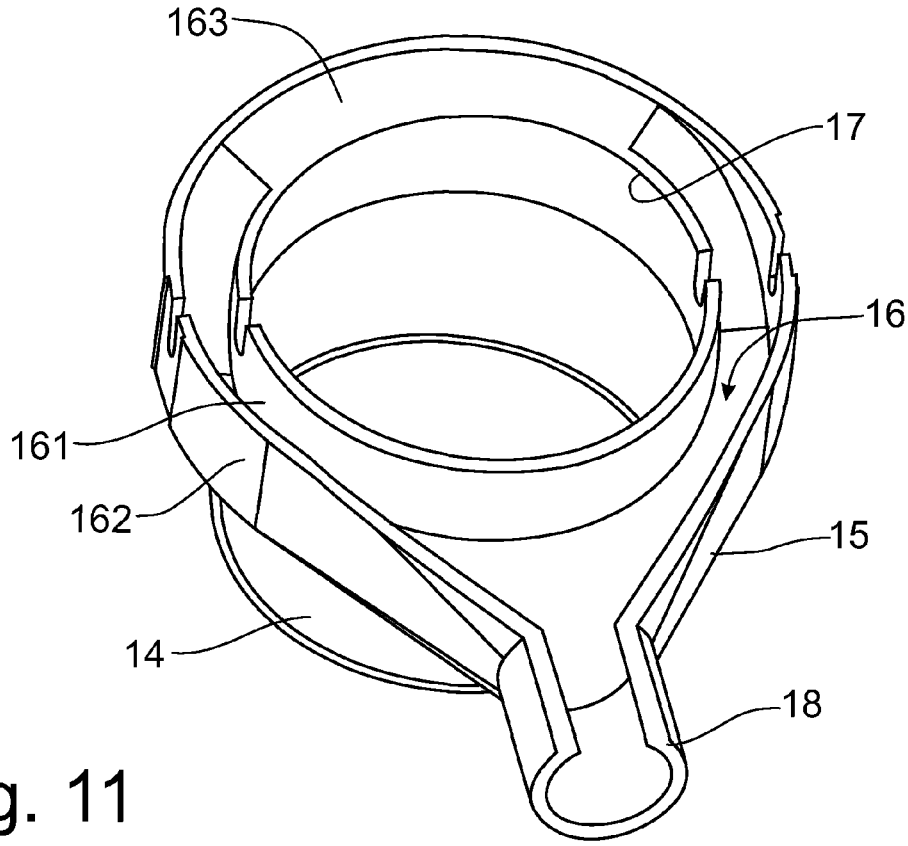
Fig. 11

Fig. 12
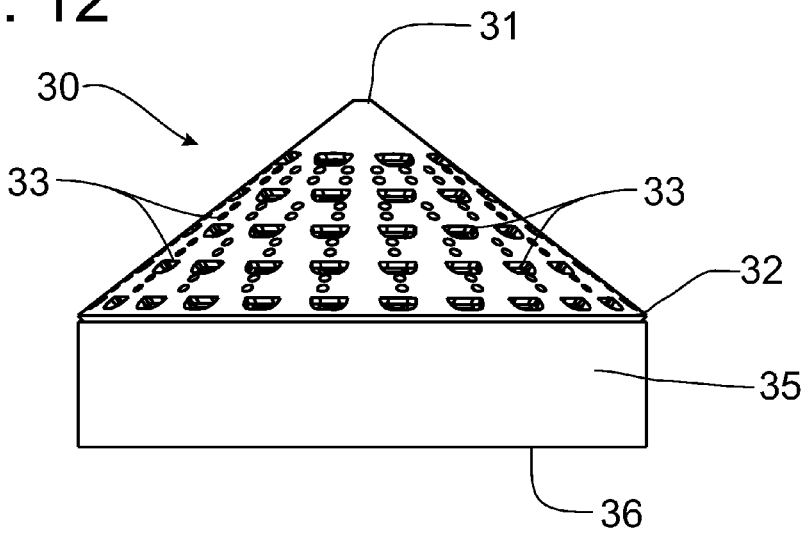
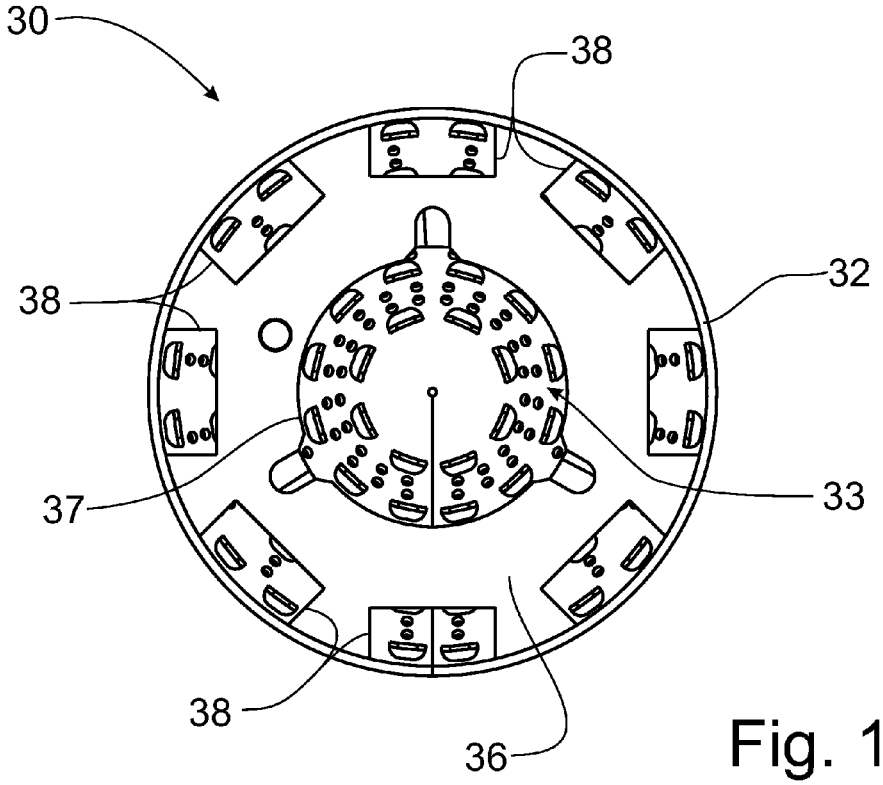
Fig. 13

Fig. 14
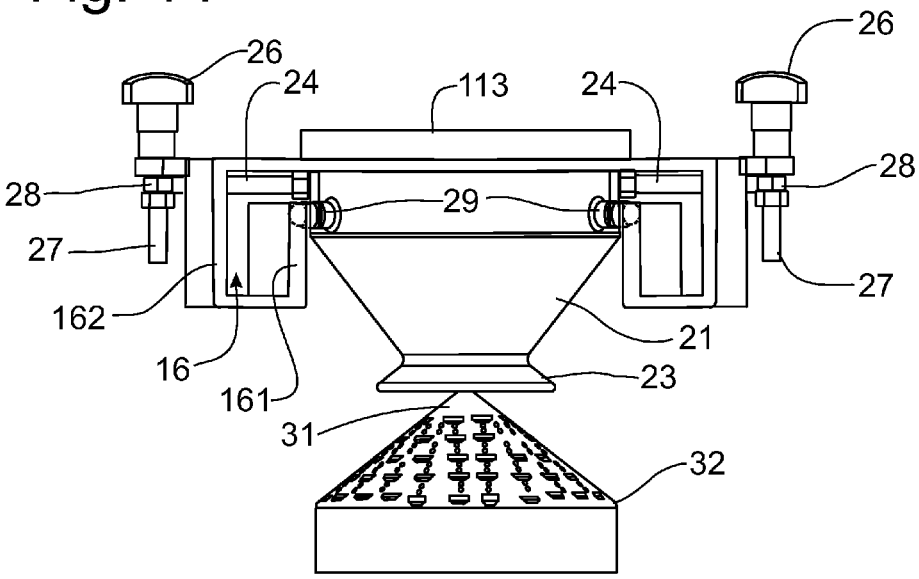
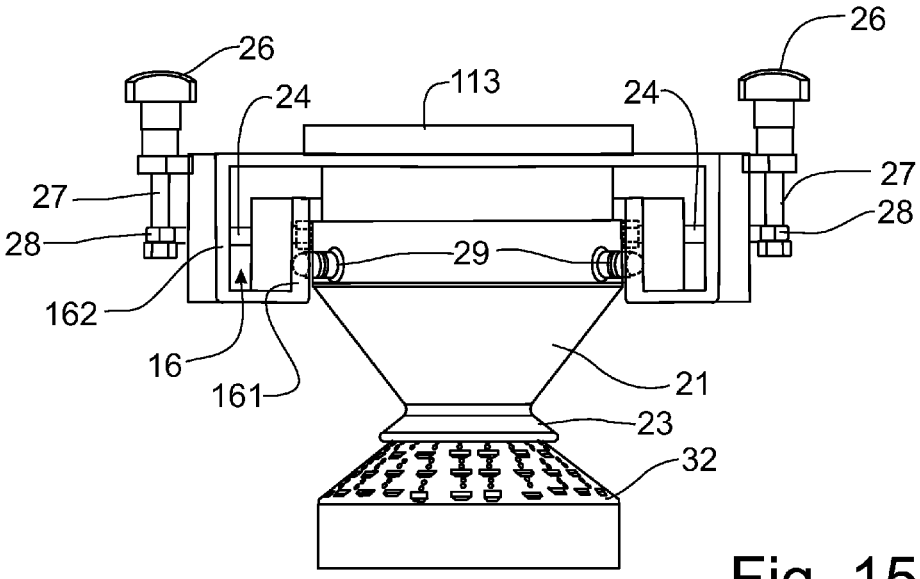
Fig. 15

Fig. 23
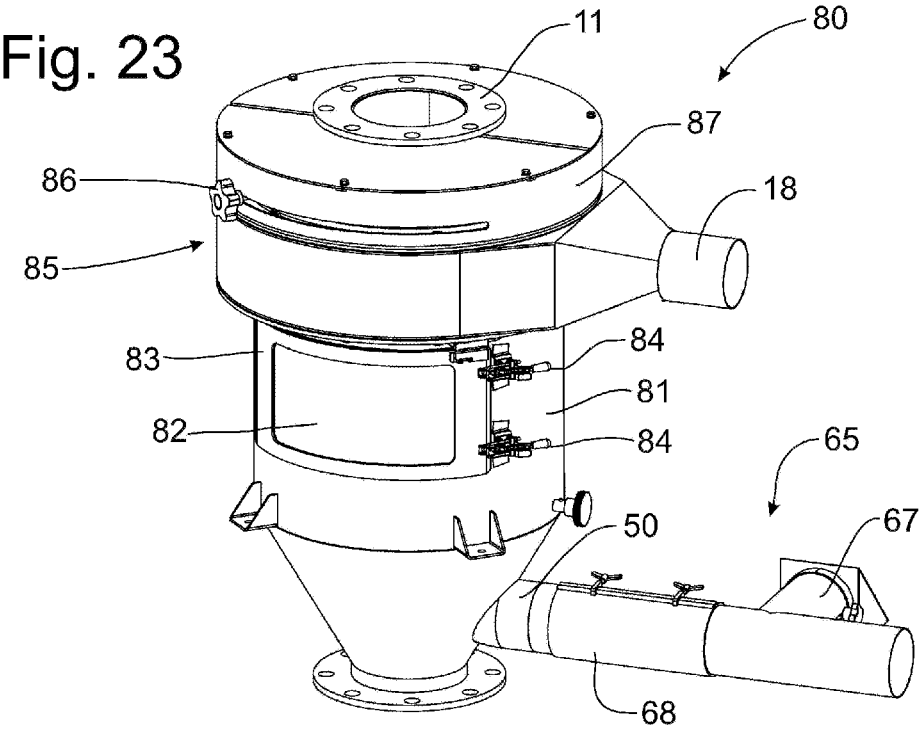
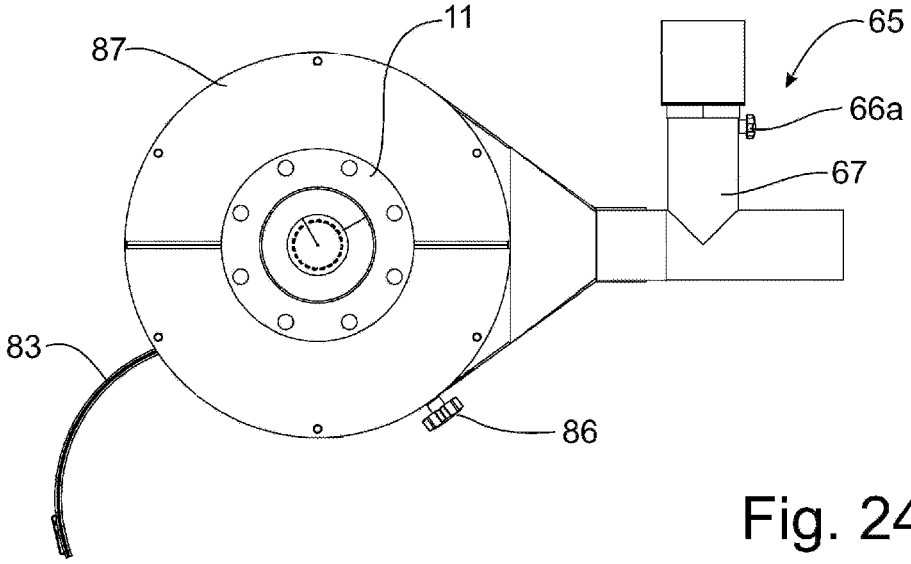
Fig. 24

CYLINDRICAL DEDUSTING APPARATUS FOR PARTICULATE MATERIAL

CROSS-REFERENCE TO RELATED APPLICATIONS

This application claims domestic priority on U.S. Provisional Patent Application Ser. No. 61/161,402, filed on Mar. 18, 2009, and entitled "Cylindrical Dedusting Apparatus for Particulate Material", the content of which is incorporated herein by reference. This application is a continuation-in-part of U.S. patent application Ser. No. 12/718,494, filed on Mar. 5, 2010, and granted as U.S. Pat. No. 8,312,994, on Nov. 20, 2012.

FIELD OF THE INVENTION

The invention disclosed in this application is directed generally to the cleaning and handling of particulate materials, such as plastic pellets, regrind, tablets, grains, minerals, and the like, and particularly to a dedusting apparatus that is configured in a cylindrical configuration to provide an increased operative capacity due to a 360 degree cleaning operation.

BACKGROUND OF THE INVENTION

It is well known, particularly in the field of transporting and using particulate materials, commonly coarse powders, granules, pellets, and the like that it is important to keep product particles as free as possible of contaminants. Particulates are usually transported within a facility where they are to be mixed, packaged or used in a pressurized tubular system that in reality produces a stream of material that behaves somewhat like a fluid. As these materials move through the pipes, considerable friction is generated not only among the particles themselves, but also between the tube walls and the particles in the stream. In turn, this friction results in the development of particle dust, broken particles, fluff, and streamers (ribbon-like elements that can "grow" into quite long and tangled wads that will impede the flow of materials or even totally block the flow). The characteristics of such a transport system are quite well known, as is the importance and value of keeping product particles as free as possible of contaminants.

The term "contaminant" as used herein includes a broad range of foreign material, as well as the broken particles, dust, fluff and streamers mentioned in the preceding paragraph. In any case, contaminants are detrimental to the production of a high quality product, and in some situations a health risk to employees of the producer and possibly even a source of danger in that some contaminants can produce a dust cloud which, if exposed to an ignition source, may explode.

Considering product quality, and focusing on moldable plastics as a primary example, foreign material different in composition from the primary material, such as dust, non-uniform material of the primary product, fluff, and streamers, does not necessarily have the same melting temperatures as the primary product and causes flaws when the material is melted and molded. These flaws result in finished products that are not uniform in color, may contain bubbles, and often appear to be blemished or stained, and, therefore, cannot be sold. Heat in the injection molding machine can vaporize dust that leads to tiny gas bubbles in the finished product. Heat also burns dust and causes "black spots", actually carbonized dust. Sometimes dust pockets in the machine don't melt and cause "soft spots" or "white spots" as these defects are commonly called. It is important to note that, since these same non-uniform materials often do not melt at the same temperature as the primary product, the un-melted contaminants cause friction and premature wear to the molding machines, resulting in downtime, lost production, reduced productivity, increased maintenance and, thus, increased overall production costs.

Conventional particulate material dedusting devices, such as is disclosed in U.S. Pat. No. 5,035,331, granted to Jerome I. Paulson on Jul. 30, 1991, utilize first and second wash decks, formed as sloped planar surfaces within the apparatus and having openings therein for the passage of pressurized air therethrough to pass through particulate material flowing along the wash decks. Between the two wash decks, the particulate material passes through a Venturi zone, which combined with the passage of air through the particulate material on the wash decks, discharges dust and other contaminates upwardly with the air flow to be discharged from the apparatus.

In U.S. Pat. No. 7,380,670, granted on Jun. 3, 2008, to Jerome I. Paulson, Heinz Schneider and Paul Wagner, a compact dedusting apparatus having back-to-back wash deck assemblies, provides increased capacity by doubling the wash decks and the Venturi zones, which requires the inflow of particulate material to be equally divided between the two wash deck assemblies. In both U.S. Pat. No. 5,035,331 and U.S. Pat. No. 7,380,670, a magnetic flux field is applied to the infeed of particulate material to neutralize the static charges attracting the contaminates to the particulate pellets to enhance the operation of the wash decks in separating contaminates from the particulate material.

Accordingly, it would be desirable to provide a dedusting apparatus that would be operable to clean contaminates from greater quantities of particulate material without increasing the overall size of the dedusting apparatus, while providing wash deck and Venturi zone operations similar to that of conventional planar wash deck dedusting apparatus.

SUMMARY OF THE INVENTION

It is an object of this invention to provide a dedusting apparatus for use with particulate material, such as plastic pellets, that provides 360 degrees of operation to remove dust and debris from the particulate material.

It is another object of this invention to provide a conical wash deck that will receive a flow of particulate material over the surface thereof to provide 360 degrees of dedusting operation for particulate material.

It is a feature of this invention to provide a material infeed apparatus that provides a flow of particulate material over a conical wash deck apparatus.

It is an advantage of this invention that the flow rate of particulate material through a dedusting apparatus can be increased without substantially increasing the size of the dedusting apparatus.

It is another advantage of this invention that the flow rate of particulate material over the conical wash deck can be adjusted by manipulating the distance between the material infeed apparatus and the conical wash deck.

It is another feature of this invention that the flow rate of particulate material over the surface of the conical wash deck can be adjusted by vertically moving the material infeed apparatus relative to the conical wash deck.

It is another feature of this invention that the tip of the conical wash deck can serve as a stopper when inserted into the frusto-conical material infeed apparatus to vary the flow rate of particulate material over the surface of the conical wash deck.

It is another object of this invention to provide a cylindrical dedusting apparatus having an air infeed duct directing the flow of air into the underside of the conical wash deck to be directed outwardly through the wash deck surface through openings formed in the wash deck.

It is still another object of this invention to provide an air discharge conduit located above the wash deck apparatus to receive a flow of air passing through the wash deck and carrying dust and debris cleaned from the particulate material fed over the surface of the wash deck.

It is still another feature of this invention that the air discharge conduit includes a circular collector formed with an air flow restriction in a portion thereof opposite a discharge conduit.

It is still another advantage of this invention that the flow restriction in the circular collector urges the collected air toward the discharge conduit by decreasing the volume of the collection chamber opposite the discharge conduit.

It is yet another feature of this invention that the discharge conduit extends radially from the circular collector.

It is yet another advantage of this invention that the radially oriented discharge conduit operates to collect air entering the circular collector uniformly from either side of the circular collector.

It is still another advantage of this invention that the conical wash deck is positionally fixed on the air infeed conduit.

It is yet another object of this invention to provide an externally operable adjustment mechanism varying the flow rate of the particulate material fed onto the wash deck.

It is a further feature of this invention that the material infeed mechanism is connected to an adjustment mechanism mounted on the circular collector such that the vertical position of the infeed mechanism can be selected by rotation of threaded knobs accessible on the exterior of the circular collector, or by operation of remotely operable air or hydraulic cylinders.

It is still a further feature of this invention that the infeed mechanism includes a frusto-conical material infeed hopper includes plastic bumpers that engage a cylindrical sleeve to keep the infeed hopper moving vertically when positionally adjusted through the threaded adjustment mechanism.

It is a further advantage of this invention that the frusto-conical infeed hopper will be centered over the tip of the conical wash deck irrespective of the vertical position selected for the infeed hopper to establish the flow rate of particulate material over the wash deck.

It is yet another object of this invention to provide a transparent housing for a portion of the dedusting apparatus to permit a viewing of the operation of the internal components removing dust and contaminates from the particulate material.

It is another feature of this invention that the housing for the cylindrical dedusting apparatus can include a transparent cylindrical portion corresponding to the conical wash deck to permit an observation of the cleaning operation of the dedusting apparatus as particulate material moves over the conical wash deck.

It is still a further advantage of this invention that the observation of the wash deck operation will permit a determination of the effectiveness of the cleaning operation and a corresponding adjustment of product flow rate or air inflow rate to maximize the efficiency of the cleaning operation.

It is yet a further advantage of this invention that the transparent central portion of the outer housing will permit an observation of the turbulence within the Venturi zone and a determination of the need for adjustment of the flow rates.

It is a further object of this invention to provide a cylindrical dedusting apparatus providing 360 degrees of cleaning operation for particulate material, which is durable in construction, inexpensive of manufacture, carefree of maintenance, facile in assemblage, and simple and effective in use.

These and other objects, features and advantages are accomplished according to the instant invention by providing a cylindrical dedusting apparatus having an upper material infeed opening to introduce material into a frusto-conical infeed hopper centered over the tip of a conical wash deck supported over an air infeed conduit. The air is blown through slots and openings in the surface of the wash deck to separate dust and debris from the particulate material. The dust-laden air is discharged by passing between the infeed hopper and a cylindrical sleeve to enter into a circular collector for discharge from the apparatus. Flow rate of material over the wash deck is adjusted by vertically moving the infeed hopper within the sleeve relative to the wash deck to vary the dimension of the gap through which material flows onto the wash deck. A closed loop air system can be used with the cylindrical dedusting apparatus with a bleed air module that reduces air flow into the apparatus.

BRIEF DESCRIPTION OF THE DRAWINGS

The advantages of this invention will become apparent upon consideration of the following detailed disclosure of the invention, especially when taken in conjunction with the accompanying drawings wherein:

FIG. 10 is a perspective view of the circular collector and the sleeve with the infeed hopper and the top plate of the circular collector removed for purposes of clarity;

FIG. 11 is a perspective horizontal cross-sectional view of the circular collector taken below the top plate to show the interior of the circular collector;

FIG. 12 is an elevational view of the conical wash deck;

FIG. 13 is a bottom plan view of the wash deck shown in FIG. 12;

FIG. 14 is a partial vertical cross-sectional view of the circular collector to show the relationship of the wash deck, infeed hopper, circular collector and sleeve when the infeed hopper is located at the maximum flow rate position as depicted in FIG. 2;

FIG. 15 is a partial vertical cross-sectional view similar to that of FIG. 14 but depicted the positioning of the infeed hopper at the minimum flow rate position as shown in FIG. 3;

FIG. 23 is a perspective view of another alternative configuration of a cylindrical dedusting apparatus incorporating an alternative configuration of a bleed air assembly;

FIG. 24 is a top plan view of the cylindrical dedusting apparatus shown in FIG. 23 with the access door opened;

DETAILED DESCRIPTION OF THE PREFERRED EMBODIMENT

Figure 1:
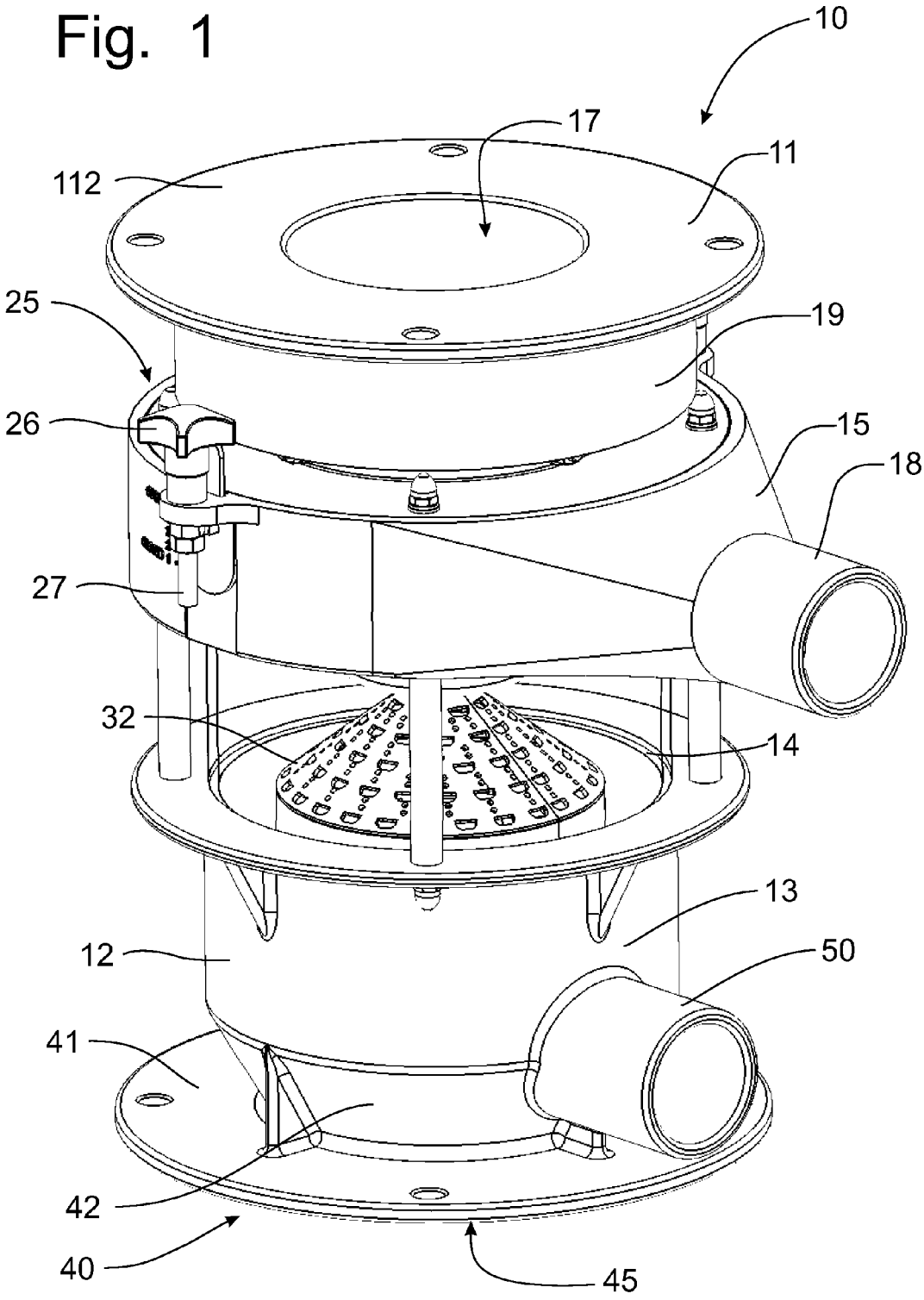
FIG. 1 is a perspective view of a cylindrical dedusting apparatus incorporating the principles of the instant invention.
Figure 2:
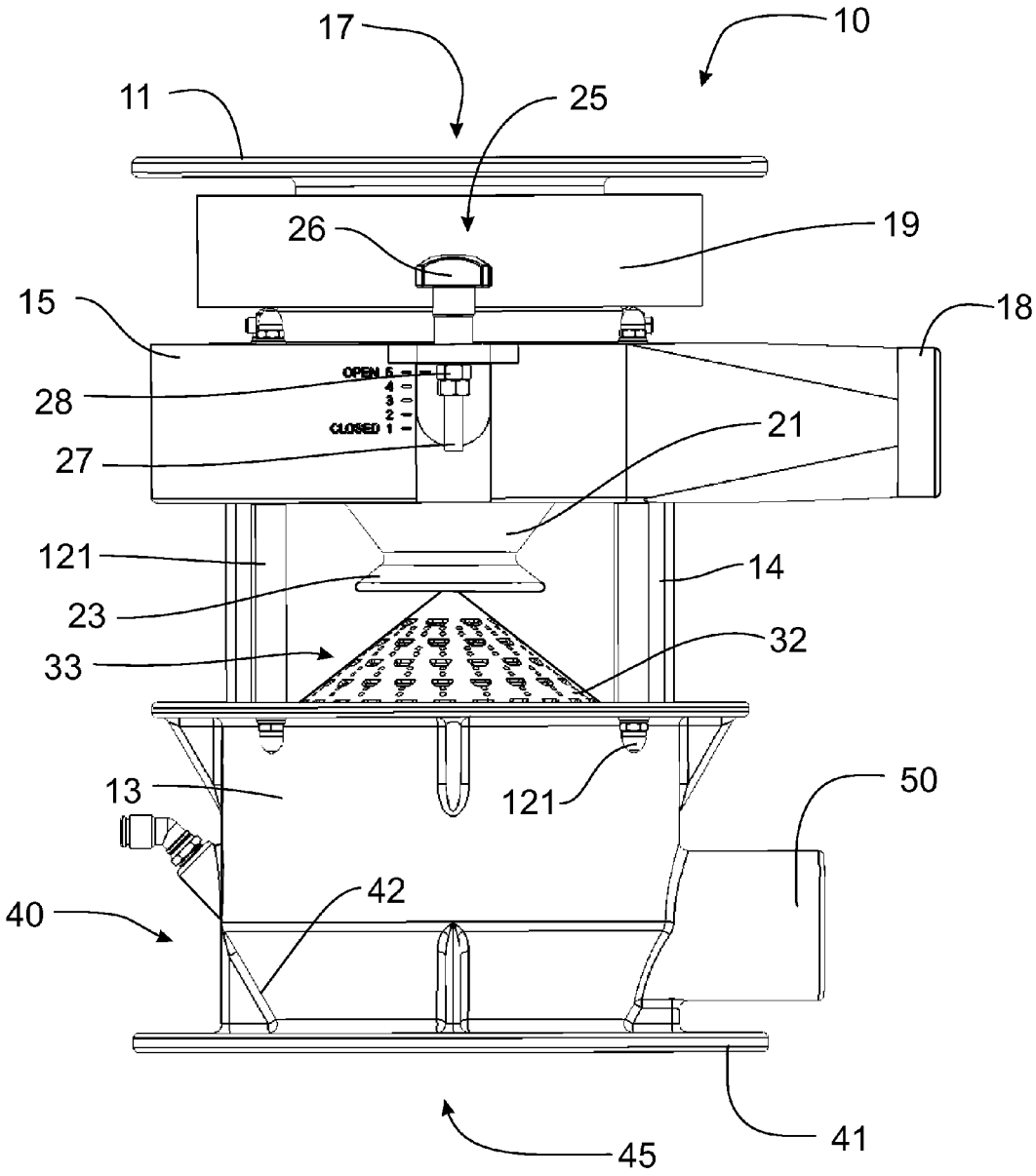
FIG. 2 is right side elevational view of the cylindrical dedusting apparatus shown in FIG. 1, the infeed hopper being positioned at a maximum height relative to the wash deck to provide a maximum flow rate of particulate material onto the conical wash deck.
Figure 3:
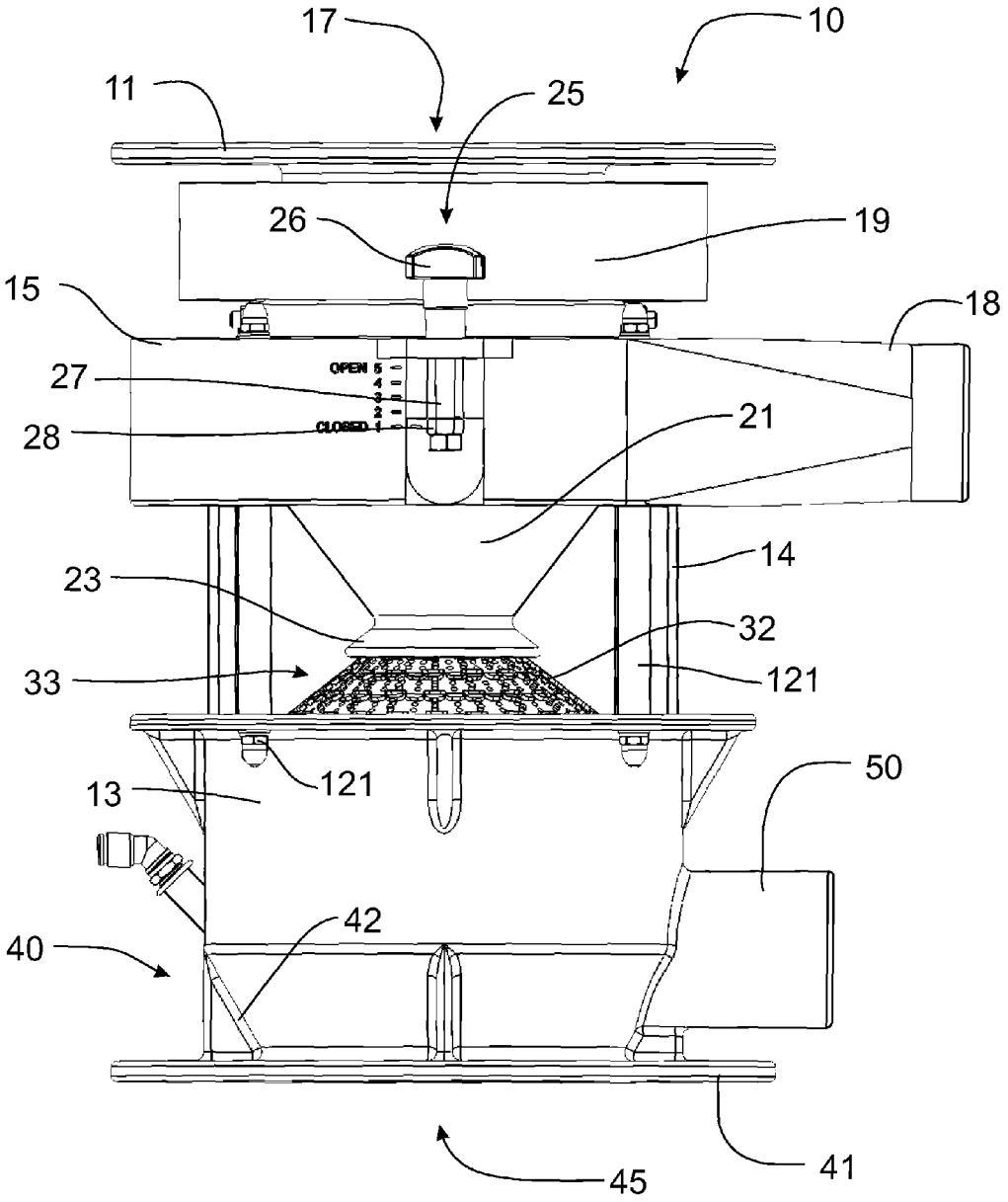
FIG. 3 is a right side elevational view of the cylindrical dedusting apparatus similar to that of FIG. 2, but with the infeed hopper lowered relative to the conical wash deck to minimize the gap therebetween and reduce the flow rate of particulate material over the wash deck.
Figure 5:
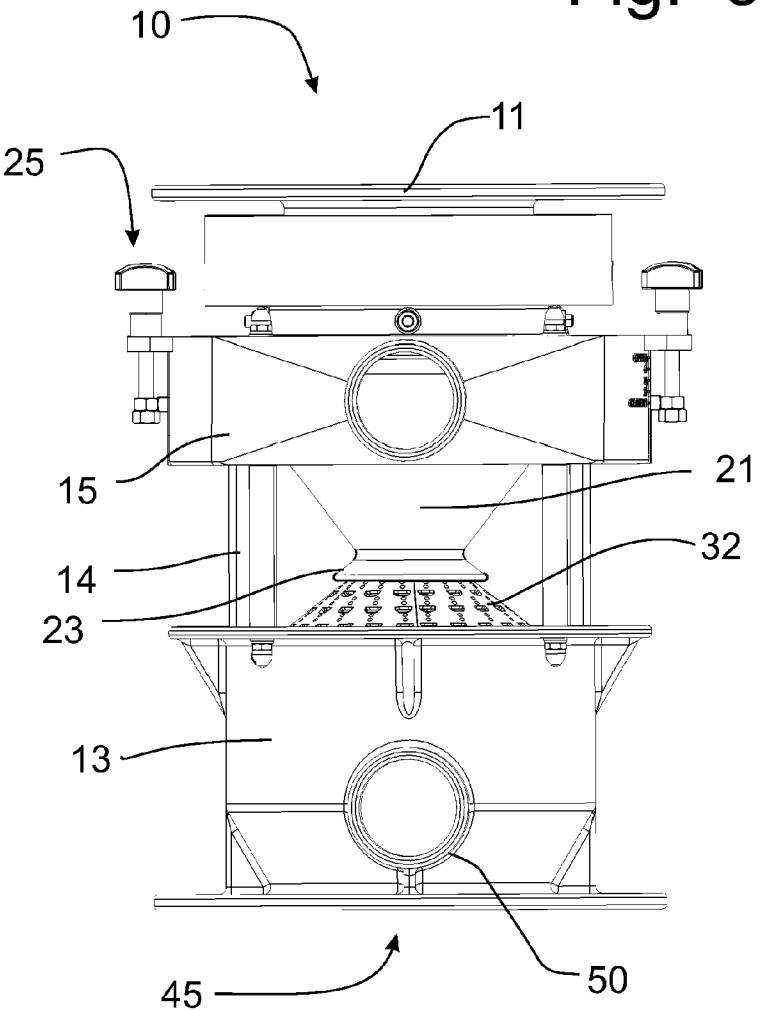
FIG. 5 is a front elevational view of the cylindrical dedusting apparatus similar to that of FIG. 4, but having the infeed hopper lowered to a minimum flow rate position as depicted in FIG. 3.
Figure 4:
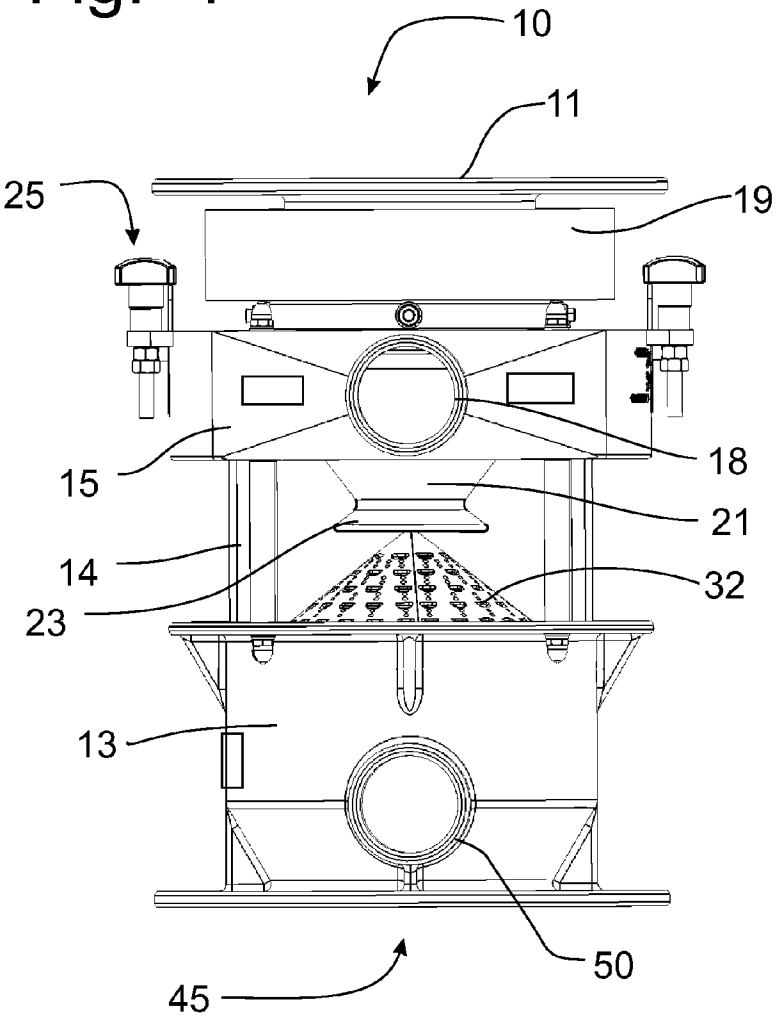
FIG. 4 is a front elevational view of the cylindrical dedusting apparatus looking into the air infeed and air discharge conduits, the infeed hopper being positioned at the maximum flow position as depicted in FIG. 2.

Referring to FIGS. 1-9, a cylindrical dedusting apparatus incorporating the principles of the instant invention can best be seen. The cylindrical dedusting apparatus utilizes the known dedusting techniques disclosed in U.S. Pat. No. 5,035,331, issued to Jerome I. Paulson on Jun. 3, 1991, including the passage of pressurized air through a sloped, slotted wash deck, and the passage of air through a Venturi zone where particulate material passes. However, these known contaminate removing techniques are structured in a different configuration heretofore unknown in the art.

The dedusting apparatus 10 is generally cylindrical in shape and configuration. The outer housing 12 is formed of cylindrical components with the dedusting apparatus 20 centrally positioned internally thereof. The housing 12 preferably includes a lower cylindrical housing member 13, a central cylindrical housing member 14 and an upper circular collector member 15 mounted on the central housing member 14 and connected to the lower housing member 13 by fasteners 121 that trap the central housing member 14 between the circular collector 15 and the lower housing member 13. A material infeed opening 111 is defined by a flanged infeed sleeve 11 that extends downwardly through the circular collector 15 to engage the infeed hopper 21, as will be described in greater detail below.

The outer cylindrical housing 12 is preferred to be in a three-part configuration to facilitate disassembly for purposes of cleaning and maintenance; however, one skilled in the art will recognize that a single-piece unitary housing could also be utilized. Although the central housing member 14 is depicted as being semi-transparent, the lower housing member 13 is preferably formed of a rigid metallic material, such as stainless steel, to provide an enhanced ability to support the air inflow conduit 50 as will be described in greater detail below. The central housing member 14 is preferably constructed of a semi-transparent or transparent polycarbonate to permit a viewing of the operation of the wash deck assembly 30. Observation of the cleaning operation at the wash deck apparatus 30 is an effective way to determine if the product flow rate and the air inflow rate need to be adjusted. Looking at the turbulence within the Venturi zone 49 provides a good indication. If too much turbulence exists, cleaned particulate material is not falling to the product discharge opening 45 and product can be carried over to the air discharge and lost from the system. In this situation, the air flow rate needs to be reduced. If insufficient turbulence exists, the product flow rate can be reduced or the air flow rate can be increased.

The circular collector 15 is mounted on top of the central housing member 14 so as to be sealed against the central housing member 14. As best seen in FIGS. 10 and 11, the circular collector 15 is formed with an annular chamber 16 having a central opening 17 therethrough where the material feed hopper 21 is mounted for the passage of particulate material to be cleaned. The circular collector 15 incorporates a radially aligned discharge pipe 18 through which the dirty, contaminate-laden air is discharged from the dedusting apparatus 10. As is described in greater detail below, dust-laden air passes around the material infeed hopper 21 and travels over the low interior wall 161 into the annular chamber 16 defined between the interior wall 161 and the higher outer wall 162.

The distal portion of the annular chamber 16 most remote from the discharge conduit 18 is formed with a sloped baffle 163 that restricts the volume of the distal portion of the annular chamber 16 so that the air velocity will be increased to carry the dust and contaminates around the annular chamber 16 to the discharge conduit 18. Preferably, negative pressure is applied to the discharge pipe 18 to enhance the flow of air from the dedusting apparatus 10. With the discharge pipe 18 exiting the air discharge ring 15 radially, the flow of air being discharged from the housing 12 will become cyclonic with increasing velocities that will further reduce pressures in the air discharge ring 15 and draw the dusty air from the housing 12 into the air discharge ring 15.

The top of the cylindrical dedusting apparatus 10 will have a mounting flange 112 for connecting to a supply hopper (not shown) in a conventional manner to provide a supply of particulate material into the cylindrical dedusting apparatus 10. Preferably, the top mounting flange 112 is spaced above the circular collector 15 to provide a mounting location for a magnetic coil 19 that generates a magnetic flux field operable to neutralize static charges between the particulate material and the contaminate particles and enhance the cleaning operation of the wash deck assemblies 30, as will be described in greater detail below.

The circular collector 15 supports a frusto-conical feed hopper 21 shaped with sloping sides somewhat like a funnel to direct the particulate material provided by the supply hopper (not shown) to a discharge opening 22 at the bottom of the frusto-conical feed hopper 21. The lowermost portion of the feed hopper 21, extending below the discharge opening 22, is formed with a reverse conical deflector member 23 that extends circumferentially around the discharge opening for purposes described in greater detail below. The sleeve 113 is received within the material infeed hopper 21 to direct particulate material into the hopper 21.

As best seen in FIGS. 8, 9, 14 and 15, the material infeed hopper 21 is preferably formed with opposing, radially extending mounting arms 24 that interconnect with corresponding adjustment mechanism 25 supported on the circular collector 15. Thus, the material infeed hopper 21 is suspended from the circular collector 15 for vertical movement relative thereto. The adjustment mechanism 25 can be a mechanical device that is manually operated and, thus, can include knobs 26 with vertically extending threaded rods 27 engaged with threaded nuts 28 on the distal ends of the mounting arms 24. Rotation of the knobs 26 in this adjustment mechanism 25 causes the mounting arms 24 and the infeed hopper 21 connected thereto to move vertically relative to the sleeve 113 and relative to the circular collector 15. For larger dedusting apparatus 10, the manually operated adjustment mechanism 25 can be replaced with a remotely operable air or hydraulic cylinder (not shown). Preferably, the material infeed hopper 21 will also include plastic bumpers 29 affixed to the exterior surface thereof to engage the interior vertical side of the low interior wall 161 and keep the hopper 21 centered with respect to the conical wash deck assembly 30.

The vertical movement of the material infeed hopper 21 varies the position of the reverse conical deflector 23 and the discharge opening 22 relative to the tip 31 of the conical wash deck assembly 30. As the reverse cone deflector 23 moves downwardly over the wash deck assembly 30, the tip 31 extends into the discharge opening 22 and restricts the flow of material through the discharge opening 22 by reducing the size of the gap 39 between the deflector 23 and the wash deck assembly 30. Thus, the lower the material infeed hopper 21 is positioned relative to the wash deck assembly 30, the lower the flow rate of particulate material through the discharge opening 22 will be. The size of the gap 39 depends on the desired flow rate and the relative size of the particulate pellets being passed over the wash deck 32. The tip 31 of the wash deck 32 is positioned centrally within the discharge opening 22 so that the tip 31 deflects a uniform flow of particulate material circumferentially over the wash deck 32. The deflector member 23 also serves to direct the flow of particulate material in a laminar manner over the wash deck 32 without allowing the particulate pellets to bounce off the wash deck 32 after dropping out of the feed hopper 21. Preferably, the exterior side of the circular collector 15 will be formed with markings to provide an indication of the flow rate.

An air inflow conduit 50 is supported on the lower housing member 13, passing radially through the lower housing member 13 to provide a supply of pressurized air into the cylindrical dedusting apparatus 10. Although not specifically shown in the drawings, one skilled in the art will recognize that the air inflow conduit 50 can be supported on struts and braces as necessary to mount the air flow conduit 50 in a fixed stationary position relative to the lower housing member 13. One skilled in the art will recognize that the specific diameter of the air inflow conduit 50 will be determined by the air flow rates and air pressures required for a specific application.

Figure 7:
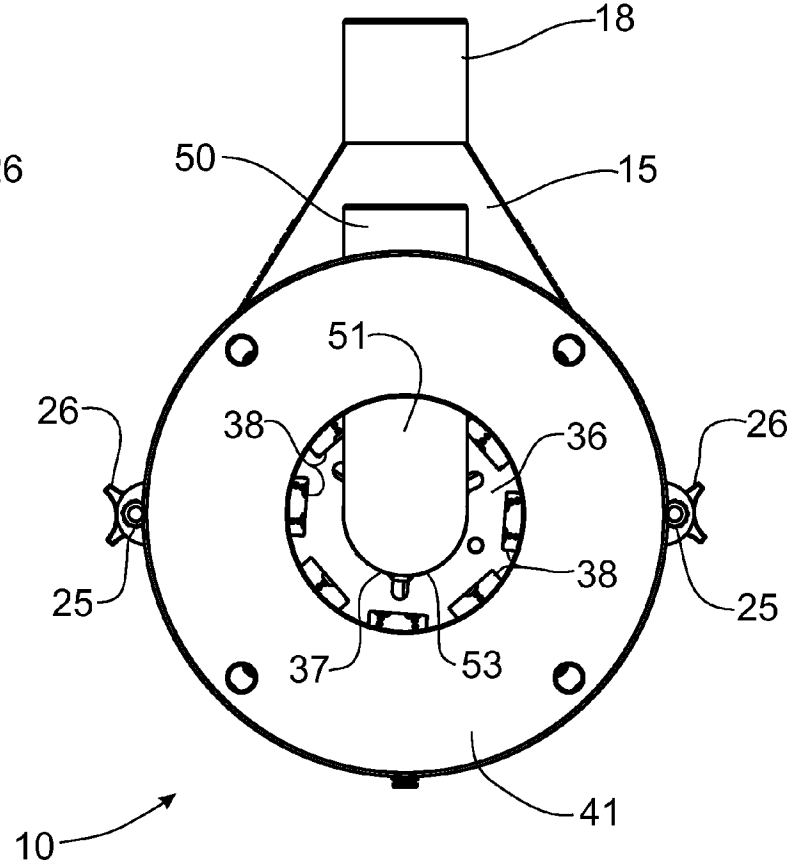
FIG. 7 is a bottom plan view of the cylindrical dedusting apparatus looking into the material discharge opening.
Figure 6:
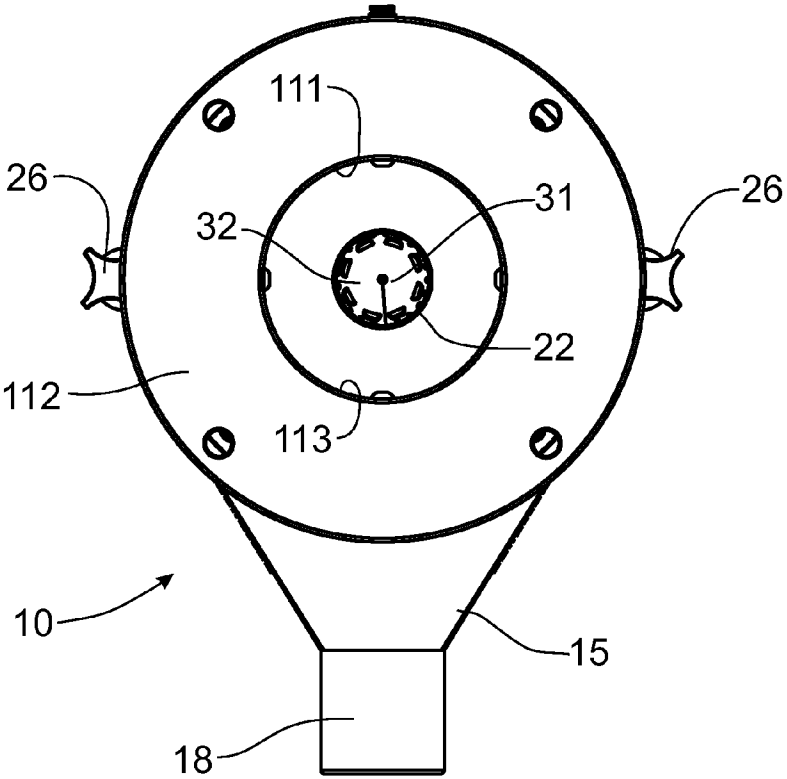
FIG. 6 is a top plan view of the cylindrical dedusting apparatus looking into the material infeed opening.
Figure 8:
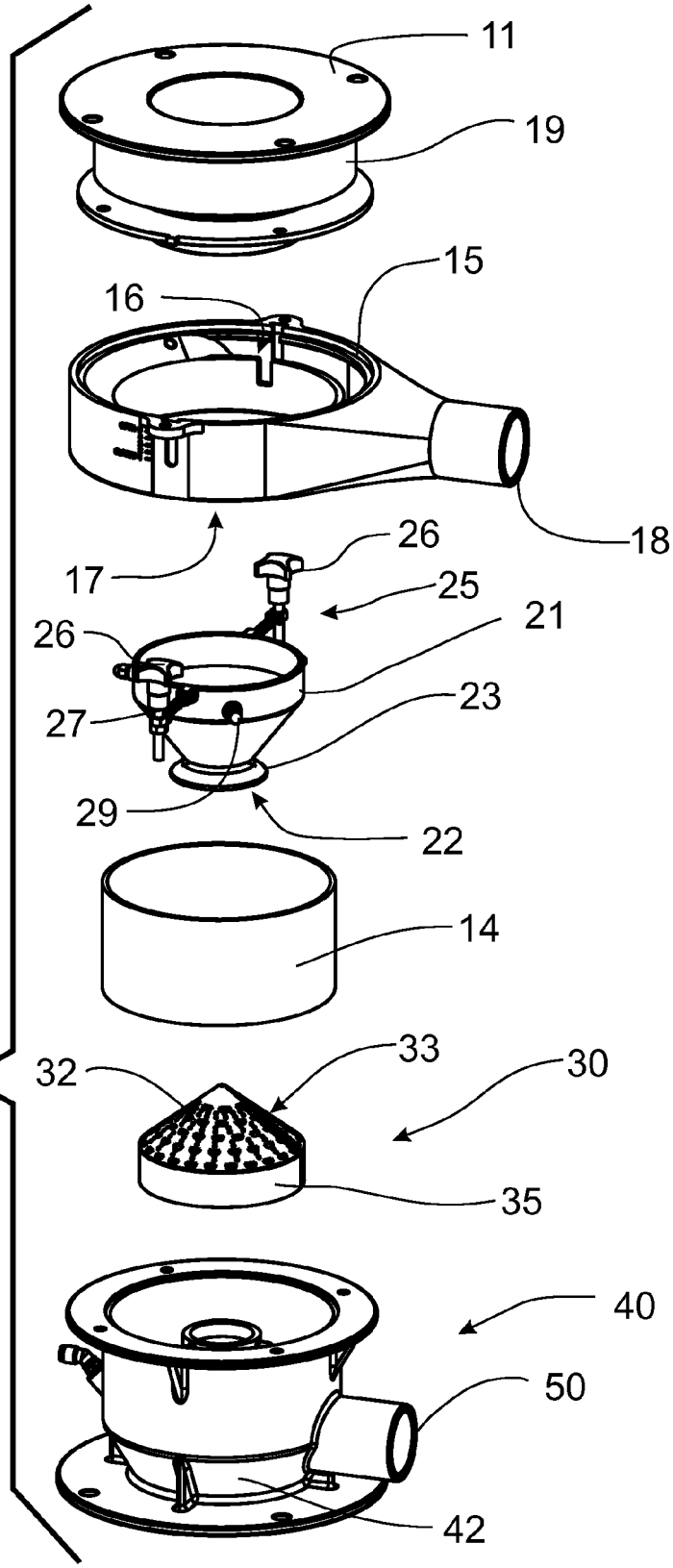
FIG. 8 is an exploded view showing the component parts of the cylindrical dedusting apparatus.

The air inflow conduit 50 is formed with a generally horizontally extending leg 51 that passes through the lower housing member 13 and terminates in an upwardly vertically extending leg 53 that is located at the center of the cylindrical dedusting apparatus 10. The terminus (not shown) of the vertically extending leg 53 passes through the bottom plate 36 of the wash deck assembly 30, as is best seen in FIG. 7, to direct a flow of air into the interior of the conical wash deck assembly 30. The wash deck assembly 30 is preferably mounted on the vertically extending leg 53 so as to be positionally fixed on the air inflow conduit 50 so that the vertically movable material infeed hopper 21 can be positioned to define the flow rate of particulate material over the wash deck assembly 30.

The wash deck assembly 30 is formed as an inverted cone affixed to or formed with a cylindrical mounting portion 35 that has a bottom plate member 36 formed with a mounting opening 37 located centrally in the bottom plate 36 to mate with and engage the terminus of the air inflow conduit 50 so that the wash deck assembly 30 can be detachably mounted onto the air inflow conduit 50. The sloping wash deck 32 is formed with a plurality of apertures 33, formed as slots and circular openings, extending around the entire peripheral surface of the wash deck 32 to direct air flow through the particulate material passing over the conical wash deck 32, as will be described in greater detail below.

The bottom member 36 of the cylindrical mounting portion 35 can be formed with a plurality of circumferentially spaced vents 38 around the perimeter of the bottom member 36, as can be seen best in FIG. 13. These vents 38 allow an escape of air from the wash deck assembly 30 to flow downwardly out of the cylindrical mounting member 35 and then upwardly toward the circular collector 15 between the outer circumference of the cylindrical mounting member 35 and the central housing member 14 to create a Venturi zone 49 for the further cleaning of the particulate material discharged off the wash deck 32, as will be described in greater detail below. In open material handling systems where the dedusting apparatus 10 is used to clean the material, a sufficient flow of air may naturally flow upwardly through the Venturi zone 49 so that the bottom plate 36 does not need to be formed with the vents 38 and all of the air fed into the wash deck assembly 30 through the air inflow conduit 50 will pass through the apertures 33 to clean the particulate material.

The apertures 33 in the wash deck 32 are formed to direct air flow uniformly through the wash deck 32 to remove contaminate particles from the particulate material passing over the wash deck 32. The drawings reflect discrete lines of apertures 33 on the wash deck 32, but one skilled in the art will recognize that other aperture distribution patterns may provide a more efficient distribution of air flow through the wash deck 32. Thus, the depiction of the apertures 33 on the wash deck 32 in the drawings is intended to be schematic and representative of an apertured wash deck 32, rather than a determinative pattern. As best seen in FIG. 12, the wash deck 32 is formed as a conical surface having a slope angle at about 38 degrees measured from a horizontal plane. If the slope of the wash deck 32 is too great, the particulate material will pass too rapidly over the wash deck 32 to allow sufficient time for the cleansing air to separate the dust and debris from the particulate material. Conversely, if the slope angle is too shallow, the particulate material will not flow properly to provide an efficient flow rate. Preferably, the slope angle is in the range of 35 to 45 degrees measured from a horizontal plane.

Figure 9:
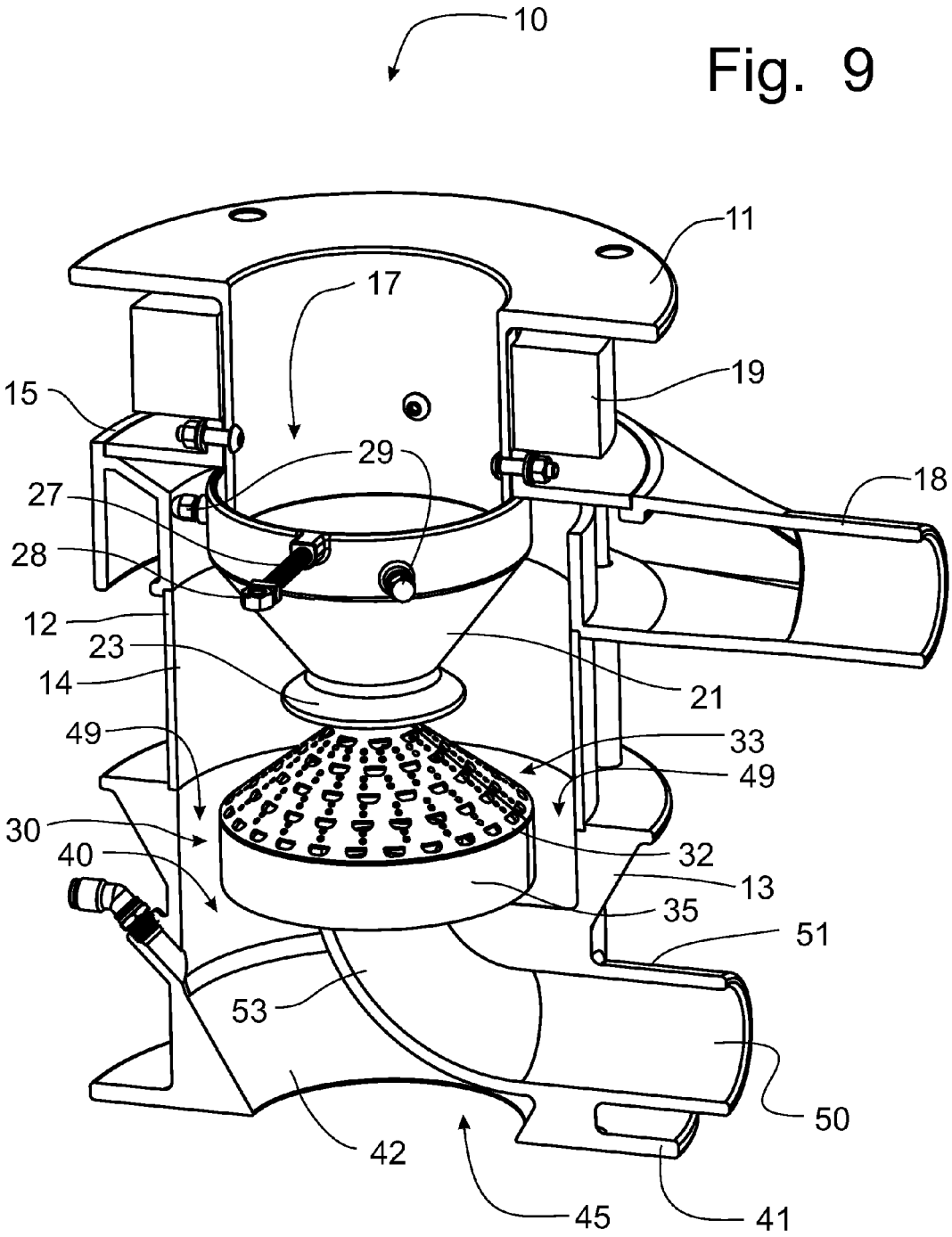
FIG. 9 is a perspective cross-sectional view of the cylindrical dedusting apparatus corresponding to lines 9-9 of FIG. 6, the wash deck and infeed hopper being retained without sectioning to show the relationship between the wash deck, the infeed hopper, the housing and the circular collector for discharging dirty air from the apparatus.

As best seen in FIG. 9, the lower housing member 13 is formed as a product discharge assembly 40, including a lower mounting flange 41 to permit connection of the cylindrical dedusting apparatus 10 to a device (not shown) that utilizes the cleaned particulate pellets being discharged from the dedusting apparatus 10. The product discharge assembly 40 also includes a frusto-conical guide pan 42 that extends from the lower housing member 13 to the central product discharge opening 45. Cleaned particulate material passing through the Venturi zone 49 between the outer periphery of the cylindrical mounting portion 35 and the upper housing member 14 will fall onto the guide member 42 which will move the cleaned particulate material into the discharge opening 45.

For purposes of cleaning and maintenance of the cylindrical dedusting apparatus 10, the circular collector 15, along with the mounted feed hopper 21 and deflector member 23, can be disconnected from the central housing member 14 and removed with the flanged material inlet sleeve 11 from the housing 12 by detaching the fasteners 121. The flanged inlet sleeve 11 and the magnetic coil 19 will typically be removed from the circular collector 15 for cleaning and servicing.

After removal of the circular collector 15 and the associated feed hopper 21, the wash deck assembly 30 can be accessed and dismounted from the terminus of the air inflow conduit 50. In addition, the central housing member 14 can be detached from the lower housing member 13 to enhance the access to the wash deck assembly 30, leaving the lower housing member 13 and the mounted air inflow conduit 50 with the product discharge assembly 40 to be cleaned independently. With the cylindrical dedusting apparatus 10 broken down into its modular components, the cleaning of the dedusting apparatus 10 is easily accomplished after which the components can be re-assembled and placed into operational form.

Figure 16:
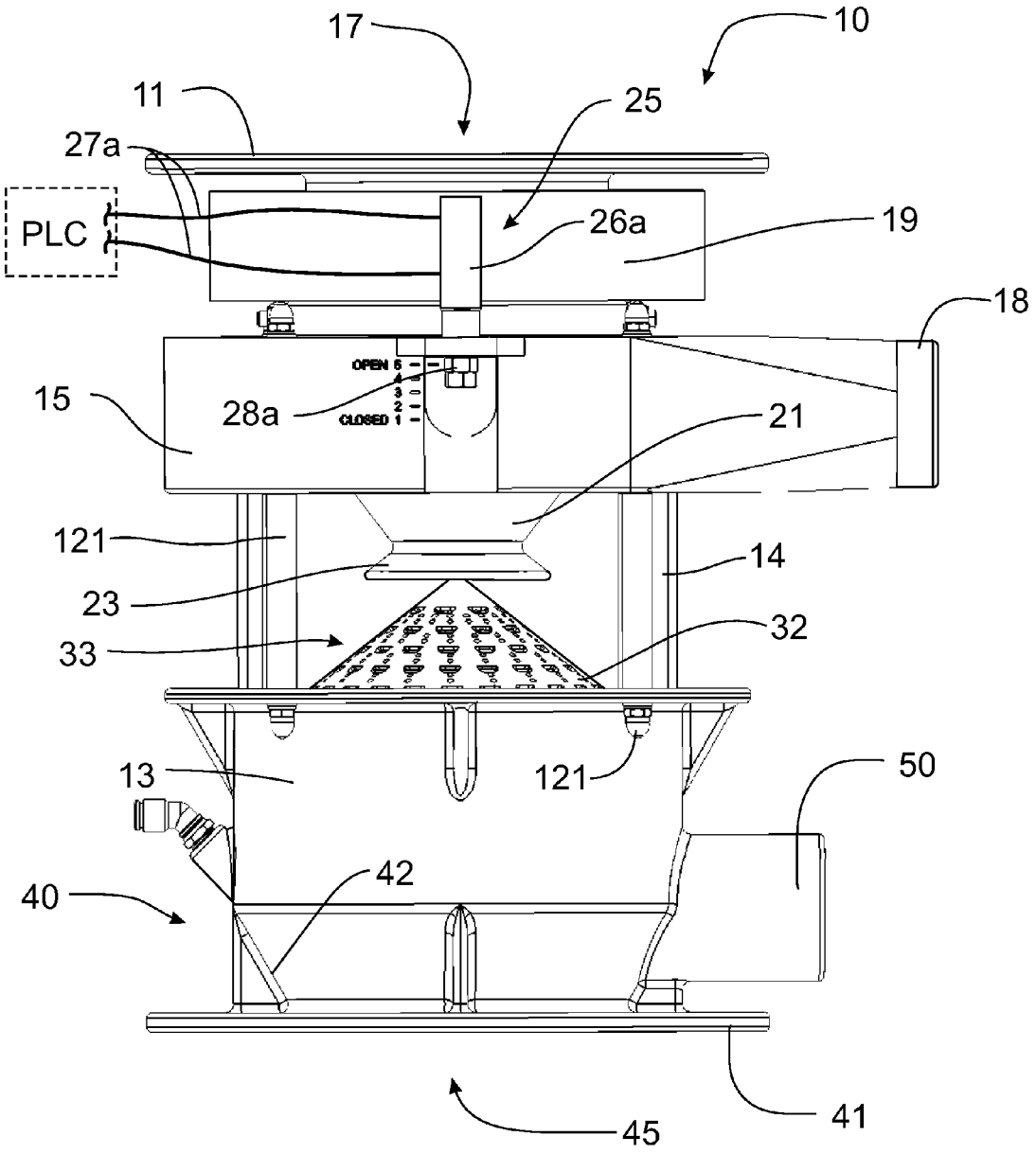
FIG. 16 is a right side elevational view of an alternative configuration of the cylindrical dedusting apparatus incorporating an apparatus for automatically adjusting the position of the infeed hopper for control of the material flow rate over the conical wash deck, the infeed hopper being raised to an uppermost position.
Figure 17:
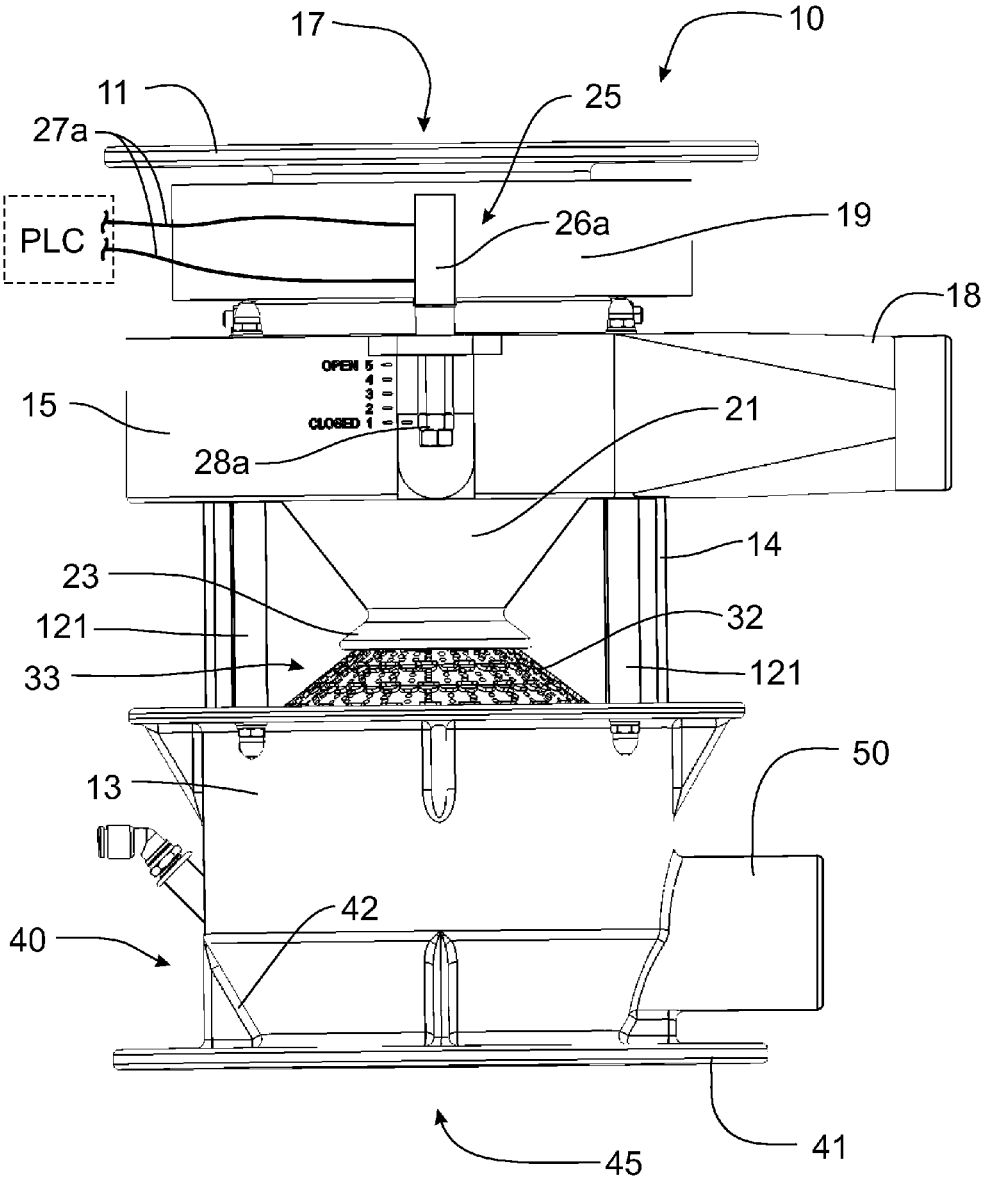
FIG. 17 is a right side elevational view of the cylindrical dedusting apparatus similar to that of FIG. 16, but with the infeed hopper lowered relative to the conical wash deck to minimize the gap therebetween and reduce the flow rate of particulate material over the wash deck.

Referring now to FIGS. 16 and 17, a mechanism for automating the flow rate of particulate material being dispensed from the feed hopper 21 can be seen. Replacing the manually operable adjustment mechanism 25 with a pair of opposing linear actuators 26*a*, which can be powered hydraulically, or more preferably electrically, through lines 27*a* to drive the feed hopper 21 vertically through extension of the rod 28*a* relative to the apex of the wash deck 32 to vary the size of the gap between the flange 23 and the wash deck 32. The actuators 26*a* can be actuated automatically through the operation of a programmable logic controller (PLC) into which parameters such as material bulk density, particle size and particle shape can be inputted from which parameters the PLC will automatically activate the linear actuators to set the flow rate for the particulate material. For example, regrind is a very light and unevenly shaped particulate material that requires a wider opening between the feed hopper flange 23 and the wash deck 32, while PET pellets are relatively heavy and generally uniformly shaped particles that flow very well and, as a result, the spacing between the feed hopper 21 and the wash deck 32 can be reduced in order to achieve the desired flow rate of material over the surface of the wash deck 32.

In operation, the flow of particulate product moves through the dedusting apparatus 10 from the inlet opening 111 to the discharge opening 45. Pressurized air is moved through the air inflow conduit 50 and discharged into the wash deck assembly 30. The pressurized air escapes from the wash deck assembly 30 through the vents 38 on the bottom member 36 of the cylindrical mounting portion 35, and through the apertures 33 on the sloped wash deck 32. The escaped air flows to the circular collector 15 at the top of the central housing member 14 for removal from the cylindrical dedusting apparatus 10 through the air discharge conduit 18.

While air is moving through the cylindrical dedusting apparatus 10, as described above, the particulate material is moving by gravity downwardly through the feed hopper 21 which concentrates through the conical shape of the feed hopper 21 the flow of particulate material moving through the discharge opening 22. The tip 31 of the wash deck 32 projecting into the discharge opening 22 at the center of the discharge opening 22 equally divides the particulate material around the tip 31 for continued downward movement over the sloped wash deck 32. The rate of flow of the particulate material is controlled by the positional adjustment of the infeed hopper 21 relative to the wash deck assembly 30 to vary the width of the gap 39 between the upper portion of the wash deck 32 and the deflector member 23.

The air flowing outwardly through the apertures 33 in the wash deck 32 provide the first cleaning action to the particulate material to separate contaminate material therefrom as the particulate material passes over the sloped wash deck 32. With the apertures 33 extending along the length of the wash deck 32, the particulate material is subjected to cleaning action along the entire path of the particulate material over the wash deck 32. Ultimately, the particulate material falls off of the sloped wash deck 32 and passes along the cylindrical mounting portion 35. The flow of air escaping through the vents 38 around the outer circumference of the bottom plate member 36 passes through the particulate material falling past the cylindrical mounting portion 35 through the Venturi zone 49 to subject the particulate material to a second cleaning action.

The size of the Venturi zone 49 enables the air escaping through the vents to increase velocity as the air passes through the Venturi zone 49. The velocity of the air has to be high enough to subject the particulate material to an aggressive cleaning action, but not so high as to carry the particulate material upwardly and prevent the movement of the particulate material to the product discharge assembly 40. The size of the Venturi zone 49 is product specific and can be adjusted by the size of the wash deck assembly 30, or by varying the size of the outer housing 12. Accordingly, if the size of the Venturi zone 49 needs to be reduced, a larger wash deck assembly 30 can be mounted on the vertically extending leg 53 of the air inflow conduit 50. Furthermore, the vertical positioning of the deflector member 23 relative to the wash deck assembly 30 is typically product specific and can be secured in the desired location.

After passing through the Venturi zone 49, the particulate material drops onto the guide member 42 and is moved into the product discharge opening 45 for discharge from the cylindrical dedusting apparatus 10. The dust-laden air, having separated dust and other contaminate materials from the flow of particulate material passing over the wash deck 32 and through the Venturi zone 49, carries the dust and contaminates upwardly to the circular collector 15 where the dust-laden air is removed from the cylindrical dedusting apparatus 10 through the air discharge conduit 18.

Operational capacity, in terms of the amount of particulate material being cleaned by the cylindrical dedusting apparatus 10 over a given period of time, is increased, as compared to the conventional flat plate dedusting apparatus, represented in U.S. Pat. No. 5,035,331 and in U.S. Pat. No. 7,380,670, due to the 360 degree cleaning operation of the cylindrical dedusting apparatus 10. Thus, the cylindrical dedusting apparatus 10 provides a greater wash deck area for a given overall size of the housing 12 than can be obtained in the conventional flat plate dedusting apparatus. The Venturi zone 49 extends circumferentially around the wash deck assembly 30, instead of simply at the end of the wash deck on the conventional flat plate dedusting apparatus.

Figure 18:
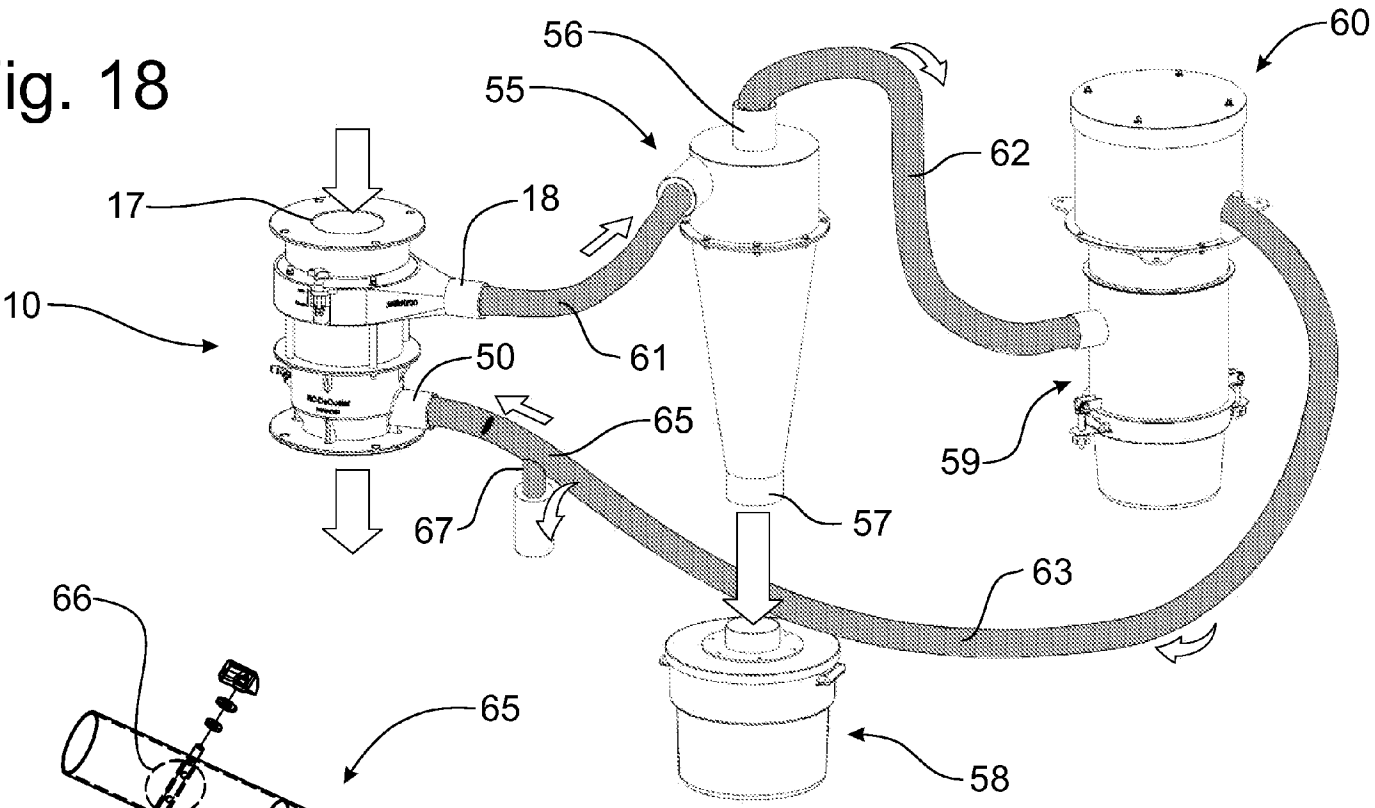
FIG. 18 is a schematic diagram of a closed circuit air flow system for supplying air into the cylindrical dedusting apparatus.
Figure 19:
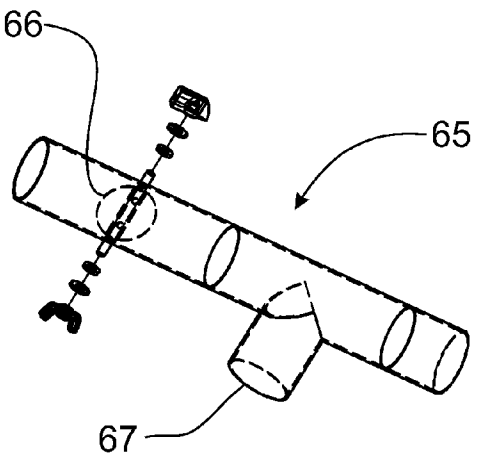
FIG. 19 is a perspective exploded view of the bleed air assembly module forming part of the system shown in FIG. 18.

Referring now to FIGS. 18 and 19, a closed air circuit system 60 for the cylindrical dedusting apparatus 10 can best be seen. Referring to the operation of the cylindrical dedusting apparatus 10 above, the contaminate-laden air discharged from the cylindrical dedusting apparatus 10 through the air discharge port 18 is conveyed via a first conduit 61 to a cyclonic separator 55 within which the contaminate-laden air is circled to separate the dust and debris contaminates from the air. The cleaned air is then discharged through the air port 56 while the collected debris falls down through the bottom discharge port 57 to a dust drum 58. The cleaned air is then conveyed through the second conduit to the fan 59 which operates to impart energy into the air to drive the air through the closed loop system 60. A replaceable filter (not shown) is built into the fan 59 to remove residual dust that may still be entrained in the cleaned air flow. Preferably the fan 59 is rotated at about 3000 RPM to drive the air through the system 60, pulling the contaminate-laden air out of the cylindrical dedusting apparatus 10 and returning cleaned air into the air inlet port 50 for recycled use.

A modular bleed air assembly 65 is provided between the fan 59 and the cylindrical dedusting apparatus 10 to control the flow of air into the air inlet port 50. As is apparent from the description of the operation of the cylindrical dedusting apparatus 10 above, the flow of air through the cylindrical dedusting apparatus 10 is accomplished via a pressure differential between the inlet of clean air through the air inlet port 50 and the discharge of contaminate-laden air from the air discharge port 18, with the negative pressure at the top of the dedusting apparatus 10 being greater than the positive pressure at the bottom of the dedusting apparatus 10.

The bleed air module 65 located in the third conduit 63 delivering air from the fan 59 to the cylindrical dedusting apparatus 10 bleeds off some of the air flow into the air inlet port 50 by obstructing the air flow through the bleed air assembly 65 with a rotatably movable baffle 66. The baffle 66 restricts the movement of air through the bleed air assembly 65 so that a corresponding portion of the air flow is redirected out of the third conduit 63 through the by-pass port 67. Replacement air comes into the cylindrical dedusting apparatus 10 downwardly through the material infeed hopper 21 and upwardly through the material discharge opening 22. The baffle 66 is rotatable within the module 65 so that the orientation of the baffle 66 can be selectively adjusted to control the amount of air passed through the by-pass port 67.

Figure 20:
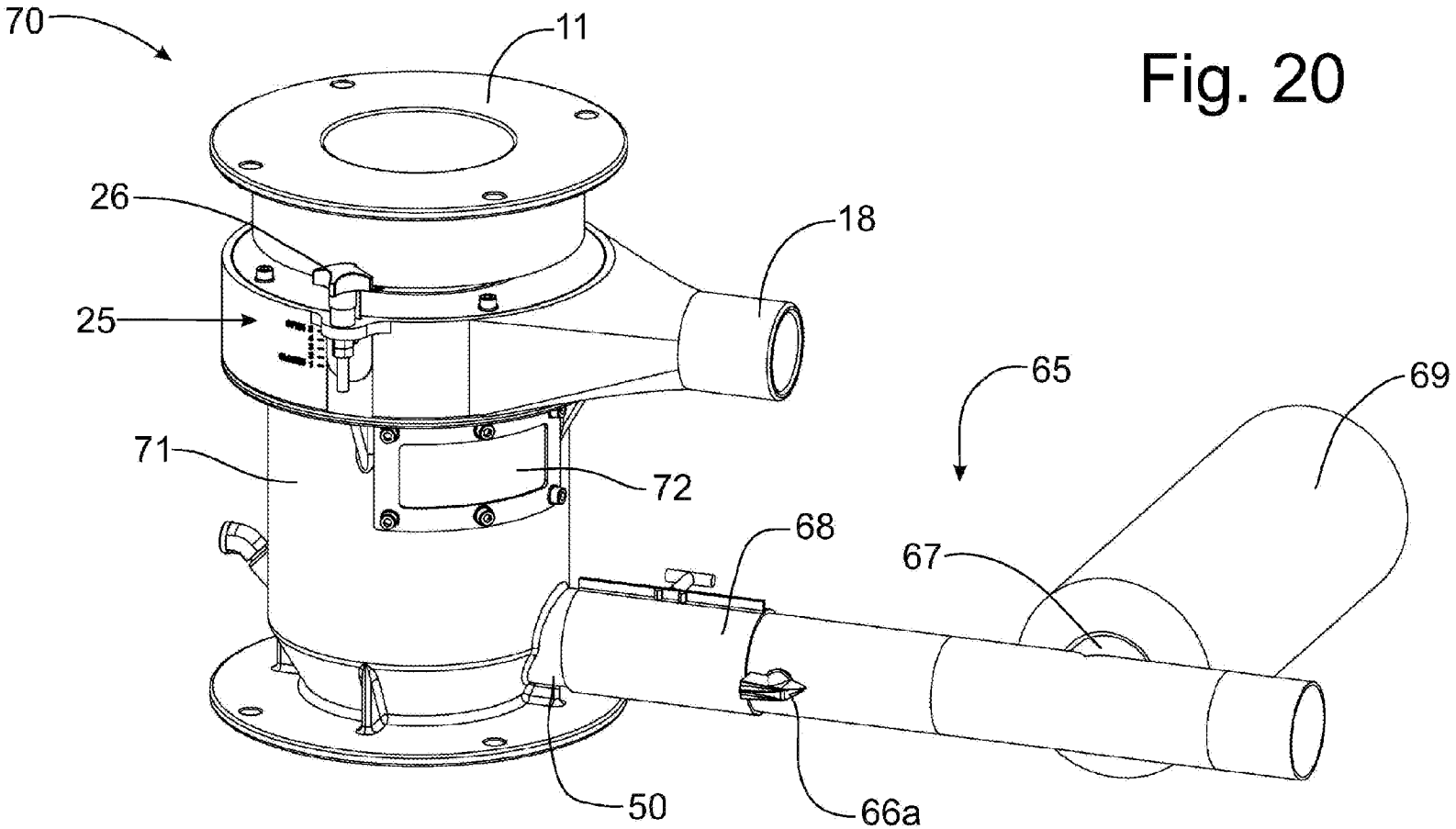
FIG. 20 is a perspective view of an alternative configuration of a cylindrical dedusting apparatus incorporating a bleed air assembly.
Figure 22:
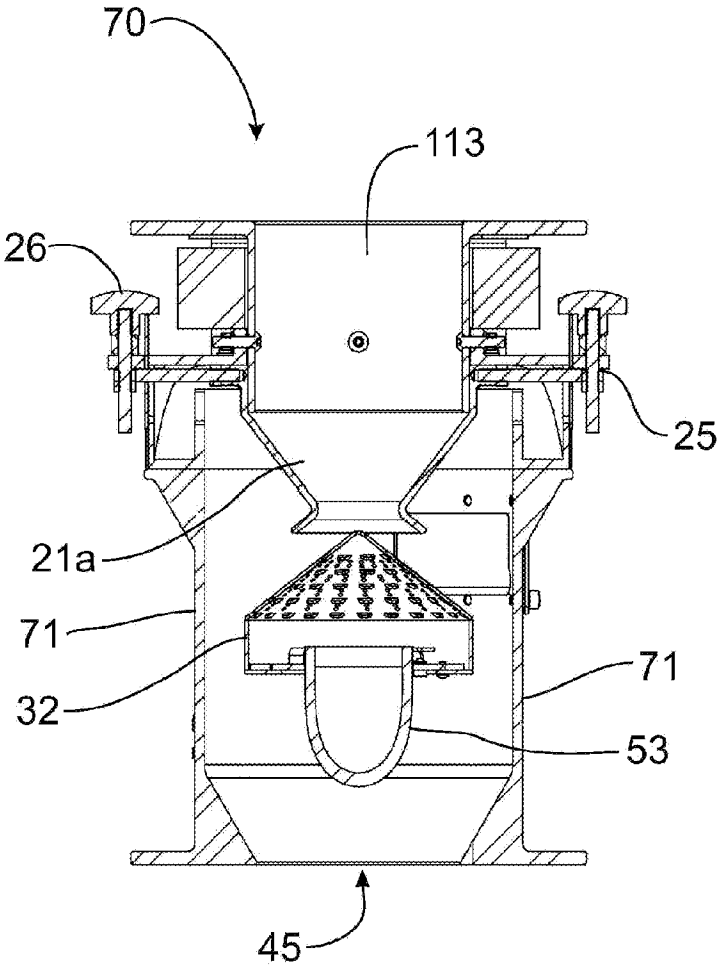
FIG. 22 is a cross-sectional view of the cylindrical dedusting apparatus taken along lines 22-22 in FIG. 21.
Figure 21:
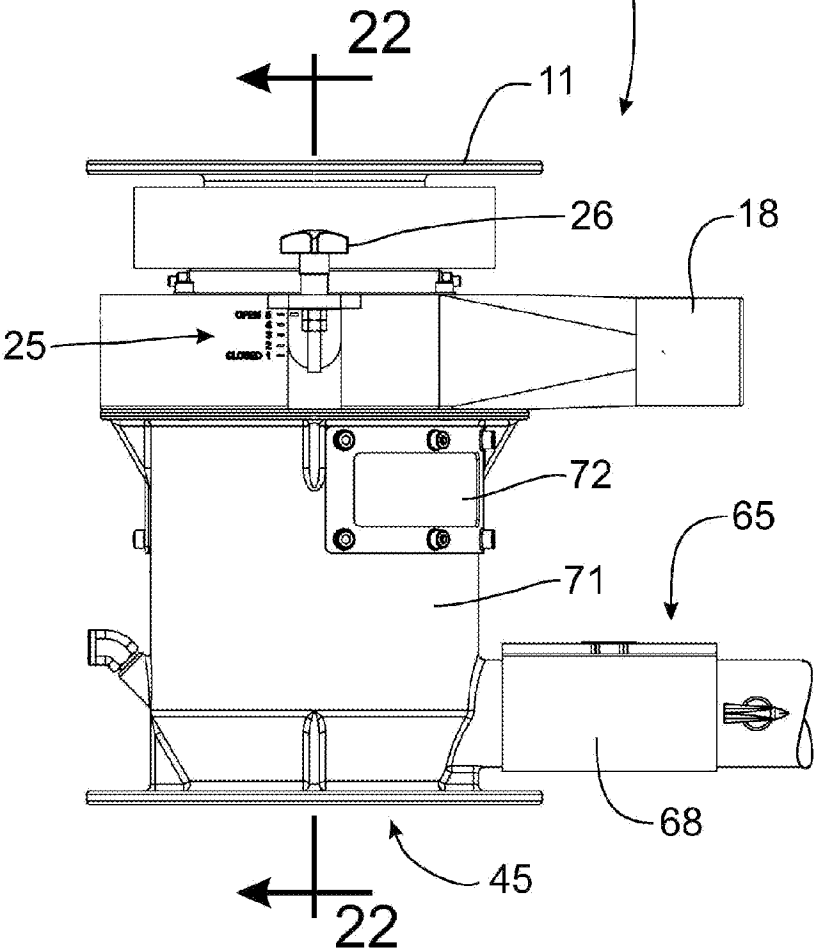
FIG. 21 is an elevational view of the cylindrical dedusting apparatus shown in FIG. 20, a portion of the bleed air assembly being broken away.
Figure 26:
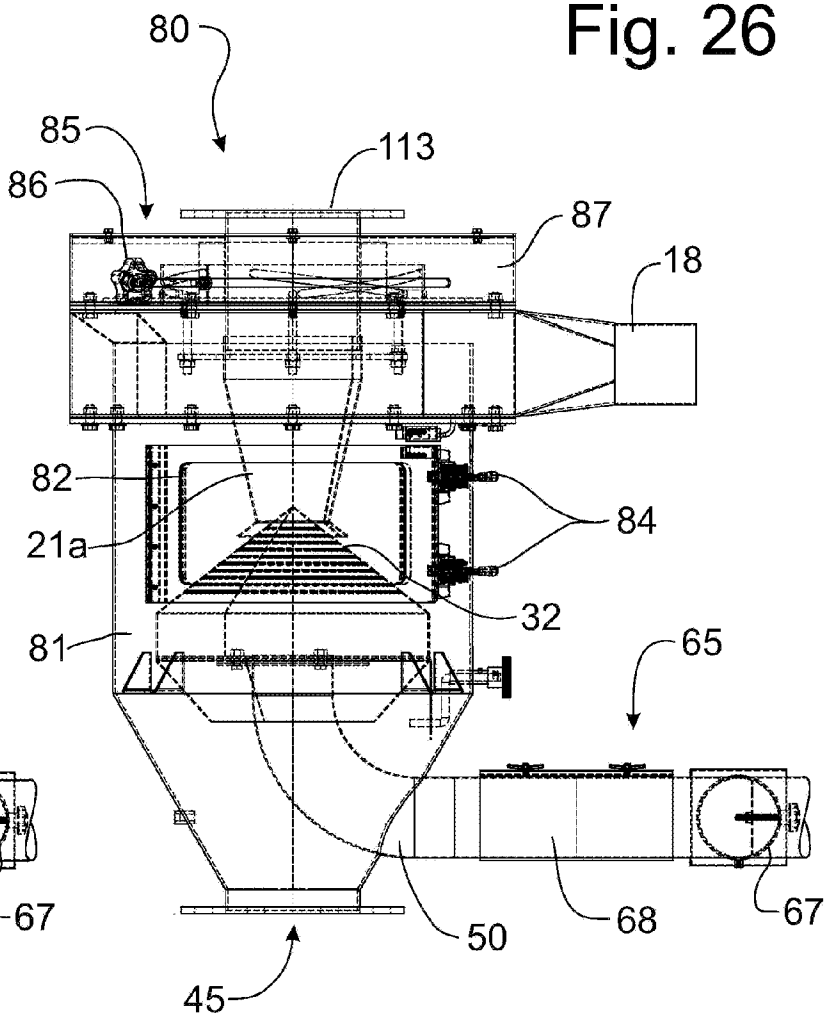
FIG. 26 is a schematic elevational view of the cylindrical dedusting apparatus shown in FIG. 23 with the material feed hopper lowered into a minimum flow position.
Figure 25:
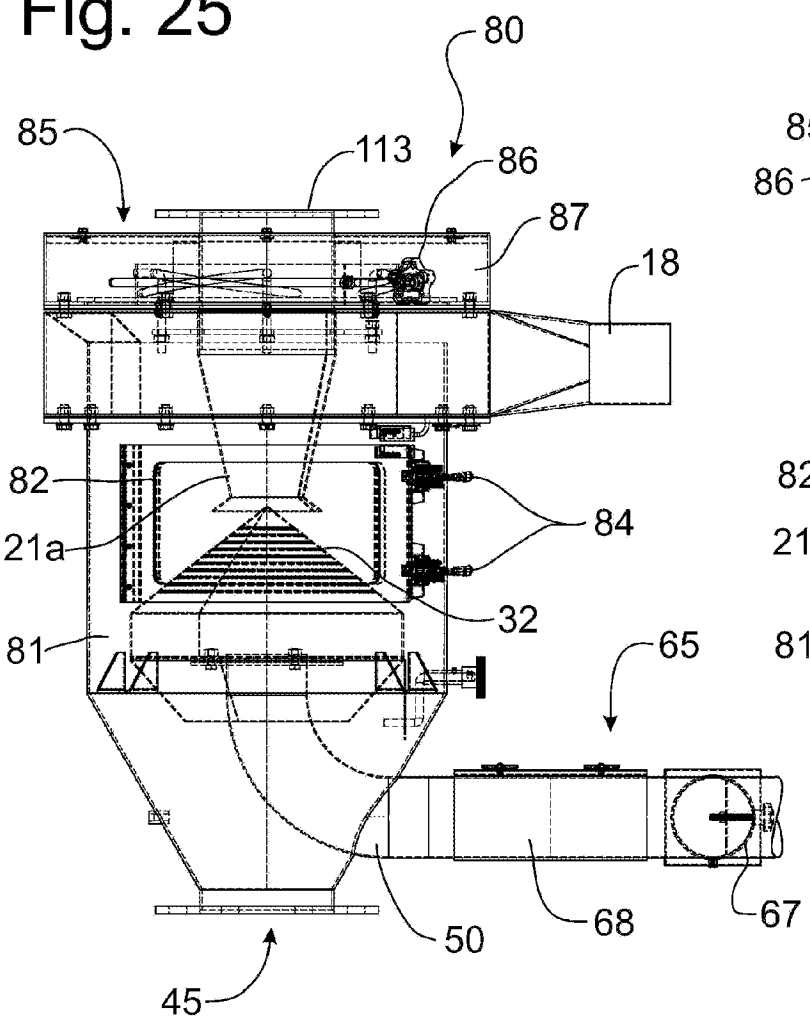
FIG. 25 is a schematic elevational view of the cylindrical dedusting apparatus shown in FIG. 23 with the material feed hopper raised into a maximum flow position.

Referring now to FIGS. 20-22, an alternative configuration of the cylindrical dedusting apparatus 70 can best be seen. The outer housing 71 is largely opaque but a transparent window 72 is provided within the outer housing 71 to allow the operation of the internal wash deck assembly 30 to be viewed. The opaque outer housing 71 enables the outer housing 71 to be formed as a unitary structure as a weldment or a casting. The vertical positional adjustment of the particulate material feed hopper 21 is accomplished through manipulation of the adjustment mechanism 25 by manually rotating the knobs 26 as described in greater detail above, or in the alternative through linear actuators as is also described above. Preferably, the funnel portion 21*a* is movably supported on exterior of the infeed inlet sleeve 113 by the adjustment mechanism 25 so that the funnel portion 21*a* can move vertically relative to the wash deck 32 and control the flow rate of particulate material over the wash deck 32. The bleed air assembly 65 is coupled to the air inlet port 50 by a coupling device 68, the internal baffle (not shown) being controlled through manipulation of the adjustment knob 66*a*. A muffler 69 is connected to the by-pass port 67 to dissipate the bleed air by reducing the velocity thereof.

Yet another alternative configuration of the cylindrical dedusting apparatus 80 can be seen in FIGS. 23-26. This second alternative configuration of the dedusting apparatus 80 has a larger diameter than the first alternative configuration 70 and has a greater capacity for cleaning particulate material. As with the first alternative configuration 70, the second alternative configuration 80 has a unitary, opaque outer housing 81 and a transparent window 82, which can be hinged to provide an access opening, as is reflected in FIG. 24. The frame 83 of the transparent window 82 is hinged on one side and is formed with latching devices 84 on the opposing side to close the window frame 83 against the outer housing 81. The bleed air assembly 65 is also connected to the air inflow conduit 50 by a coupler 68, but the baffle (not shown) is located in the by-pass port 67 and positionally controllable through manipulation of an adjustment knob 66*a* so that the volume of air passing through the by-pass port 67 can be selectively controlled, which in turn controls the flow of cleaned air into the air inflow conduit 50.

Figure 28:
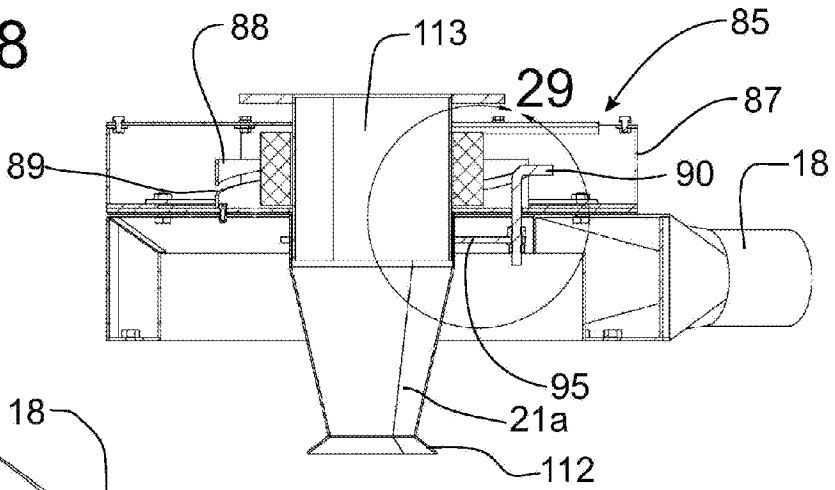
FIG. 28 is a cross-sectional view of the upper platform showing the adjustment mechanism for vertically moving the material infeed hopper and controlling the flow rate of particulate material over the conical wash deck, taken along lines 28-28 of FIG. 27.
Figure 29:
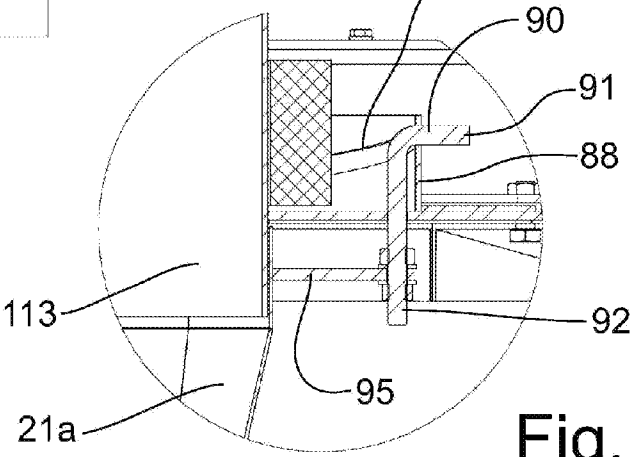
FIG. 29 is a detail view of one of the cam followers forming part of the infeed hopper adjustment mechanism corresponding to circle 29 in FIG. 28.
Figure 27:
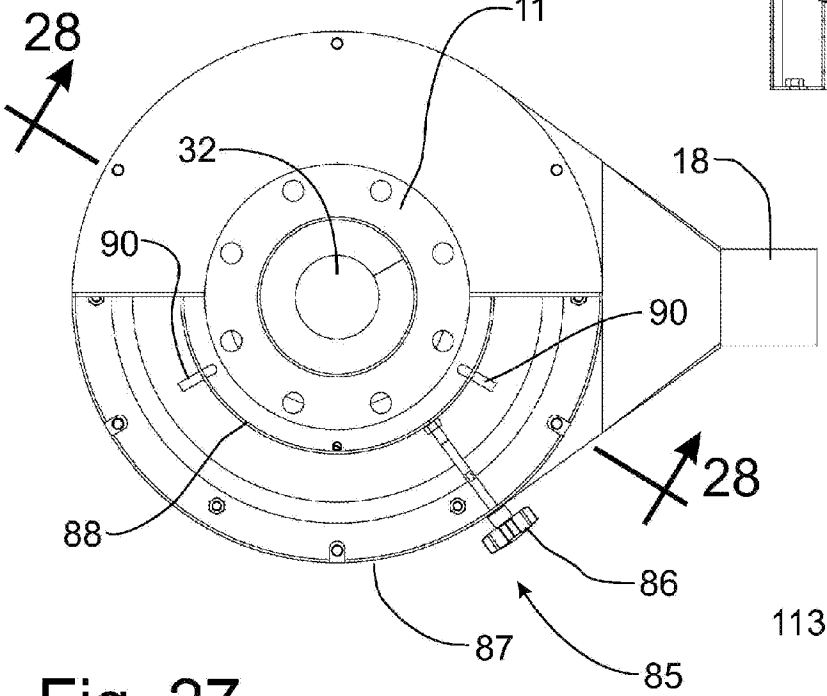
FIG. 27 is a top plan view of the upper platform of the cylindrical deduster depicted in FIG. 23, a portion of the top plate of the upper platform being broken away for purposes of clarity.

As is best seen in FIGS. 27-29, manipulation of the vertical position of the funnel portion 21*a* of the material infeed hopper 21, which is movably supported on the exterior of the inlet sleeve 113, is controlled through manipulation of the adjustment mechanism 85 housed within an upper platform 87. An adjustment knob 86 is slidable around the circumference of the upper platform 87 and is secured to a circular cam member 88 to rotate the circular cam member 88 about its center vertical axis. The cam member 88 is formed with three angled guide grooves 89 that correspond with three support arms 95 affixed to and extending outwardly from the funnel portion 21*a* of the material infeed hopper 21 at equidistant locations around the circumference of the funnel portion 21*a*. A cam follower 90 preferably in the form of an angled pin, as best seen in the detail view of FIG. 29, has an orthogonal portion 91 engaged with each corresponding guide groove 89 and a vertical portion 92 secured to the corresponding support arm 95.

In operation, the feed rate of the particulate material is adjusted by moving the adjustment knob 86 around the circumference of the upper platform 87 to an appropriate desired setting. The movement of the adjustment knob 86 around the circumference of the upper platform 87 rotates the circular cam member 88 which causes the cam followers 90 to move along the corresponding guide grooves 89 that forces the cam followers 90 to move vertically. The fixed connection of the cam followers 90 to the support arms 95 of the funnel portion 21*a*, as a result, causes the funnel portion 21*a* to move vertically relative to the sleeve 113, thus changing the dimension of the gap between the flange 112 and the conical wash deck 32.

It will be understood that changes in the details, materials, steps and arrangements of parts, which have been described and illustrated to explain the nature of the invention will occur to and may be made by those skilled in the art upon a reading of this disclosure within the principles of the scope of the invention. The foregoing description illustrates the preferred embodiment of the invention; however, concepts, as based upon the description may be employed in other embodiments without departing from the scope of the invention. Accordingly, the following claims are intended to protect the invention broadly, as well as in the specific form shown.

Having thus described the invention, what is claimed is:

1. A dedusting apparatus for cleaning contaminates from particulate material, comprising:

a cylindrical housing;

a feed hopper supported on said housing and terminating in a product inlet opening;

an air supply apparatus supported by said housing at a lower portion to provide a flow of air into said housing;

an inverted conical wash deck and having an apex positioned centrally within said product inlet opening, said wash deck including a top surface formed with a plurality of apertures for the passage of air through said wash deck, said top surface being devoid of said apertures within a predetermined distance of said apex and having said apertures uniformly covering said top surface to provide a flow of air through said wash deck to remove contaminates from said particulate material flowing over said top surface, said wash deck being centrally supported within said housing to define a Venturi zone around said wash deck between said wash deck and said housing, said air supply apparatus directed a flow of air into said Venturi zone to clean particulate material falling off of said wash deck; and an air discharge collector for collecting air passing through said wash deck apertures and through said Venturi zone.

2. The dedusting apparatus of claim 1 wherein said wash deck is formed with a bottom plate member having a central opening therein for the passage of said air supply apparatus to direct air through said apertures in said wash deck, said bottom plate member including vents arranged around a circumferential edge thereof to allow air to move through said vents and upwardly between said wash deck and said housing to create said Venturi zone around said wash deck.

3. The dedusting apparatus of claim 1 wherein said air discharge collector is mounted on said housing above said wash deck, said Venturi zone surrounding said wash deck assembly opening upwardly into an expanded volume that allows air velocity to reduce before entering said air discharge collector.

4. The dedusting apparatus of claim 1 wherein said apex is positioned within said product inlet opening, said feed hopper including a conical deflector overlapping an upper portion of said top surface to control the flow of particular material from said feed hopper onto said wash deck.

5. The dedusting apparatus of claim 1 wherein said air discharge collector includes an annular chamber surrounding a central opening in said air discharge collector, said annular chamber being defined by an interior wall defining said central opening and an exterior wall, said exterior wall projecting higher than said interior wall so that air can pass between said feed hopper and said interior wall can flow over said interior wall into said annular chamber.

6. The dedusting apparatus of claim 5 wherein said air discharge collector is formed with a radially extending air discharge conduit in flow communication with said annular chamber.

7. The dedusting apparatus of claim 6 wherein said annular chamber includes a baffle in a distal portion thereof opposite said air discharge conduit to restrict the cross-sectional area of said annular chamber to increase the velocity of said air within said distal portion.

8. The dedusting apparatus of claim 1 wherein said cylindrical housing includes a transparent member to permit observation of the operation of the wash deck internally of said housing.

9. The dedusting apparatus of claim 8 wherein said transparent member is supported in a frame hinged on the cylindrical housing and including latching devices to secure said frame to said housing.

10. A dedusting apparatus for cleaning contaminates from particulate material, comprising:

a cylindrical housing;

a feed hopper supported on said housing and terminating in a product inlet opening;

an air supply apparatus supported by said housing at a lower portion to provide a flow of air into said housing;

an inverted conical wash deck and having an apex positioned centrally within said product inlet opening, said wash deck including a top surface formed with a plurality of apertures for the passage of air through said wash deck; and an air discharge collector mounted above said conical wash deck for collecting air passing through said wash deck apertures, said air discharge collector including an annular chamber surrounding a central opening in said air discharge collector, said annular chamber being defined by an interior wall defining said central opening and an exterior wall to collect air moving upwardly from said wash deck into said central opening, said air discharge collector including a radially extending air discharge conduit in flow communication with said annular chamber, said annular chamber including a baffle in a distal portion thereof opposite said air discharge conduit and extending between said exterior and interior walls to restrict the cross-sectional area of said annular chamber to increase the velocity of said air within said distal portion.

11. The dedusting apparatus of claim 10 wherein said feed hopper is located within said central opening such that said air moves around said feed hopper, over said interior wall and into said annular chamber.

12. A dedusting apparatus for cleaning contaminates from particulate material, comprising:

a cylindrical housing;

a feed hopper supported on said housing and terminating in a product inlet opening, said feed hopper being operably supported on linear actuators that can be remotely powered to cause vertical movement of said feed hopper relative to said housing;

an air supply apparatus supported by said housing at a lower portion to provide a flow of air into said housing;

an inverted conical wash deck mounted on said housing and having an apex positioned centrally within said product inlet opening to receive particulate material therefrom, said wash deck including a top surface formed with a plurality of apertures for the passage of air through said wash deck, the vertical movement of said feed hopper changing the dimensions of a gap separating said product inlet opening from said conical wash deck such that the rate of flow of particulate material over said conical wash deck can be selectively controlled; and an air discharge collector mounted above said conical wash deck for collecting air passing through said wash deck apertures, said air discharge collector including an annular chamber surrounding a central opening in said air discharge collector to collect air moving upwardly from said wash deck into said central opening.

13. The dedusting apparatus of claim 12 wherein said feed hopper includes a conical deflector overlapping an upper portion of said top surface to control the flow of particular material from said feed hopper onto said wash deck.

14. The dedusting apparatus of claim 13 wherein said conical deflector is formed as a flange having an angled orientation that is generally parallel to said top surface of said conical wash deck.

15. The dedusting apparatus of claim 14 wherein said wash deck is supported on said air supply apparatus and is fixed positionally relative to said cylindrical housing, said cylindrical housing including a transparent central housing member corresponding to said wash deck to permit observation internally of said housing.

16. The dedusting apparatus of claim 12 wherein said linear actuators are electrically operated and are controlled by a programmable controller.

17. A dedusting apparatus for cleaning contaminates from particulate material, comprising:

a cylindrical housing;

a feed hopper supported on said housing and terminating in a product inlet opening;

an air supply apparatus supported by said housing at a lower portion to provide a flow of air into said housing;

an inverted conical wash deck and having an apex positioned centrally within said product inlet opening, said wash deck including a top surface formed with a plurality of uniformly spaced apertures for the passage of air through said wash deck to remove contaminates from said particulate material flowing over said wash deck, said top surface sloping from said apex at a slope angle in the range of 35 to 45 degrees measured from a horizontal plane passing through said conical wash deck to provide flow of particulate material by gravity over said wash deck at an appropriate velocity to allow the passage of air through said apertures to remove contaminates from said particulate material; and an air discharge collector mounted above said conical wash deck for collecting air passing through said wash deck apertures.

18. The dedusting apparatus of claim 17 wherein said top surface of said wash deck is oriented at approximately 38 degree slope.

19. The dedusting apparatus of claim 18 wherein said conical wash deck is centrally supported within said housing and defines a Venturi zone circumferentially around said wash deck between said wash deck and said housing, said air supply apparatus directed a flow of air into said Venturi zone to clean particulate material falling off of said wash deck.

20. The dedusting apparatus of claim 19 wherein said wash deck is formed with a bottom plate member having a central opening therein for the passage of said air supply apparatus to direct air through said apertures in said wash deck, said bottom plate member including vents arranged around a circumferential edge thereof to allow air to move through said vents and upwardly between said wash deck and said housing to create said Venturi zone around said wash deck.

21. The dedusting apparatus of claim 20 wherein said feed hopper is movable vertically relative to said wash deck to vary a positional relationship of said apex within said product inlet opening.

22. A dedusting apparatus for cleaning contaminates from particulate material, comprising:

a cylindrical housing defining a clean air inlet port, a dirty air discharge port and a cleaned product discharge opening;

a feed hopper supported on said housing and terminating in a product inlet opening;

a closed loop air supply apparatus supported by said housing at a lower portion thereof to provide a flow of air into said housing, said closed loop air supply apparatus including:

a fan providing a flow of air;

a cleaning apparatus for removing contaminates from said contaminate-laden air discharged from said dirty air discharge port, said clean apparatus being positioned between said dirty air discharge port and said fan to remove said contaminates before said flow of air reaches said fan;

a first conduit interconnecting said dirty air discharge port and said fan;

a second conduit interconnecting said fan and said clean air inlet port; and a bleed air module connected to said second conduit to bleed off a portion of the flow of air provided by said fan before reaching said clean air inlet port;

an inverted conical wash deck having an apex positioned centrally within said product inlet opening, said wash deck including a top surface formed with a plurality of apertures for the passage of air through said wash deck, said conical wash deck being centrally supported within said cylindrical housing to define a Venturi zone circumferentially surrounding said conical wash deck between said conical wash deck and said cylindrical housing; and an air discharge collector mounted above said conical wash deck for collecting air passing through said wash deck apertures, said air discharge collector terminating in said dirty air discharge port.

23. The dedusting apparatus of claim 22 wherein said cleaning apparatus comprises:

a cyclonic separator connected to said first conduit to remove said contaminates from said flow of air.

24. The dedusting apparatus of claim 22 wherein said bleed air module includes a baffle restricting the flow of air through said bleed air module and a by-pass port to allow a portion of the flow of air to be directed away from said clean air inlet port.

25. The dedusting apparatus of claim 24 wherein said baffle is rotatable to vary selectively the resistance to the flow of air through said bleed air module and control the amount of air directed through said by-pass port.

26. The dedusting apparatus of claim 25 wherein said bleed air module requires that less air in passed into said clean air inlet port than is passed out of said dirty air discharge port, the differential in the amount of air being supplied into said cylindrical housing through said product inlet opening and said cleaned product discharge opening.

* * * * *